US011326793B2

(12) United States Patent
Daniels

(10) Patent No.: US 11,326,793 B2
(45) Date of Patent: May 10, 2022

(54) ROOF VENT AND ROOF VENTILATION SYSTEM

(71) Applicant: Gregory S. Daniels, Santa Rosa, CA (US)

(72) Inventor: Gregory S. Daniels, Santa Rosa, CA (US)

( * ) Notice: Subject to any disclaimer, the term of this patent is extended or adjusted under 35 U.S.C. 154(b) by 0 days.

(21) Appl. No.: 16/229,633

(22) Filed: Dec. 21, 2018

(65) Prior Publication Data

US 2020/0200411 A1 Jun. 25, 2020

(51) Int. Cl.

| | |
|---|---|
| ***E04D 1/30*** | (2006.01) |
| ***F24F 7/02*** | (2006.01) |
| *E04D 13/17* | (2006.01) |
| *F24F 13/08* | (2006.01) |

(52) U.S. Cl.

CPC ..... *F24F 7/02* (2013.01); *E04D 1/30* (2013.01); *E04D 13/17* (2013.01); *E04D 2001/309* (2013.01); *F24F 7/025* (2013.01); *F24F 13/082* (2013.01)

(58) Field of Classification Search

CPC ..... F24F 2007/004; F24F 7/02; F24F 7/025; F24F 13/082; E04D 13/17; E04D 13/174; E04D 2001/309; E04D 1/30

See application file for complete search history.

(56) References Cited

U.S. PATENT DOCUMENTS

| | | | | |
|---|---|---|---|---|
| D30,059 | S | 1/1899 | Tracy | |
| 2,299,317 | A | 10/1942 | Fink | |
| 2,300,842 | A * | 11/1942 | Freeland | E04D 13/17 454/366 |
| D134,477 | S | 12/1942 | Leslie | |
| 2,490,220 | A * | 12/1949 | Freeland | E04D 13/03 454/366 |

(Continued)

FOREIGN PATENT DOCUMENTS

| | | |
|---|---|---|
| DE | 28 04 301 | 2/1979 |
| DE | 198 23 356 | 11/1999 |

(Continued)

OTHER PUBLICATIONS

European Extended Search Report in European Patent Application No. 14884739.5, dated Sep. 19, 2017.

(Continued)

*Primary Examiner* — Phi D A

(74) *Attorney, Agent, or Firm* — Knobbe, Martens, Olson & Bear, LLP

(57) ABSTRACT

This application relates to roof vents with diverters that prevent or reduce the likelihood that water or other debris can be driven through the vent by wind. For example, a roof vent can include a lower portion and an upper portion attached to the lower portion at an upslope edge, the upper portion angling away from the upslope edge to create a space therebetween. The roof vent can also include a front opening between the lower portion and the upper portion at a downslope edge of the upper portion to allow airflow into and out of the space. The roof vent can include a diverter positioned downslope of the front opening and attached to the lower portion for preventing or reducing the likelihood that water or other debris can be driven through the vent by wind.

16 Claims, 39 Drawing Sheets

(56) References Cited

U.S. PATENT DOCUMENTS 2,551,223 A * 5/1951 Schneider ..... F24F 7/02 454/366
2,638,835 A 5/1953 Strawsine
2,692,548 A 10/1954 Knorr
2,733,649 A 2/1956 Le Barron
3,027,090 A 3/1962 Zerhan, Jr.
3,083,633 A 4/1963 Hochberg
D204,715 S 5/1966 Martin
3,376,164 A 4/1968 Bachwansky
3,459,597 A 8/1969 Baron
D215,940 S 11/1969 Kahn
D217,610 S 5/1970 Stoop
3,553,030 A 1/1971 Lebrun
3,658,596 A 4/1972 Osborne
3,769,091 A 10/1973 Leinkram et al.
3,888,697 A 6/1975 Bogus et al.
3,895,467 A 7/1975 Clement
3,951,336 A 4/1976 Miller et al.
4,040,867 A 8/1977 Forestieri et al.
4,051,999 A 10/1977 Granger et al.
D247,510 S 3/1978 Kujawa, Jr.
4,083,097 A 4/1978 Anagnostou et al.
4,097,308 A 6/1978 Klein et al.
D249,158 S 8/1978 Morrow
4,108,580 A 8/1978 Felter
4,189,881 A 2/1980 Hawley
D254,442 S 3/1980 Cervone
4,201,121 A 5/1980 Brandenburg, Jr.
4,224,081 A 9/1980 Kawanura et al.
4,228,729 A 10/1980 Messick
4,239,555 A 12/1980 Scharkack et al.
4,251,026 A 2/1981 Siegel et al.
D259,138 S 5/1981 Giles
D261,803 S 11/1981 Bohanon, Jr.
4,314,548 A 2/1982 Hanson
4,382,435 A 5/1983 Brill-Edwards
4,383,129 A 5/1983 Gupta et al.
4,404,958 A 9/1983 Boettcher
4,418,685 A 12/1983 Frazier
4,432,273 A 2/1984 Devitt
4,433,200 A 2/1984 Jester et al.
D276,261 S 11/1984 Shaftner
4,485,264 A 11/1984 Izu et al.
4,498,267 A 2/1985 Beck
4,501,194 A 2/1985 Brown
4,510,851 A 4/1985 Sarnosky et al.
4,574,160 A 3/1986 Cull et al.
4,594,940 A 6/1986 Wolbrink et al.
4,602,739 A 6/1986 Sutton, Jr.
D285,829 S 9/1986 Lock
4,625,469 A 12/1986 Gentry et al.
4,633,769 A 1/1987 Milks
4,651,805 A 3/1987 Bergeron, Jr.
4,677,903 A 7/1987 Mathews, III
4,692,557 A 9/1987 Samuelson et al.
4,759,272 A 7/1988 Zaniewski
4,803,816 A 2/1989 Klober
4,843,794 A 7/1989 Holtgreve
4,850,166 A 7/1989 Taylor
4,860,509 A 8/1989 Laaly et al.
4,890,546 A * 1/1990 Venge ..... F24F 7/025 454/366
4,965,971 A 10/1990 Jean-Jacques et al.
4,977,818 A 12/1990 Taylor et al.
4,986,469 A 1/1991 Sutton, Jr.
D318,109 S 7/1991 Sullivan et al.
5,048,255 A 9/1991 Gonzales
5,049,801 A 9/1991 Potter
5,060,444 A 10/1991 Paquette
5,070,771 A 12/1991 Mankowski
5,078,047 A 1/1992 Wimberly
5,092,939 A 3/1992 Nath et al.
5,094,697 A 3/1992 Takabayashi et al.
5,121,583 A 6/1992 Hirai et al.
5,131,200 A 7/1992 McKinnon
5,131,888 A 7/1992 Adkins, II
5,133,810 A 7/1992 Morizane et al.
D332,139 S 12/1992 Courchesne
5,176,758 A 1/1993 Nath et al.
5,228,925 A 7/1993 Nath et al.
5,232,518 A 8/1993 Nath et al.
5,238,519 A 8/1993 Nath et al.
D342,129 S 12/1993 Goetz et al.
5,273,608 A 12/1993 Nath
5,296,043 A 3/1994 Kawakami et al.
5,316,592 A 5/1994 Dinwoodie
5,326,318 A 7/1994 Rotter
5,333,783 A 8/1994 Catan
5,364,026 A 11/1994 Kundert
5,385,848 A 1/1995 Grimmer
5,391,235 A 2/1995 Inoue
5,409,549 A 4/1995 Mori
5,419,781 A 5/1995 Hamakawa et al.
5,437,735 A 8/1995 Younan et al.
5,480,494 A 1/1996 Inoue
5,486,238 A 1/1996 Nakagawa et al.
5,505,788 A 4/1996 Dinwoodie
5,528,229 A 6/1996 Mehta
5,549,513 A 8/1996 Thomas et al.
D374,927 S 10/1996 Chabot et al.
5,575,861 A 11/1996 Younan et al.
5,591,080 A 1/1997 Ward
5,602,457 A 2/1997 Anderson et al.
5,620,368 A 4/1997 Bates et al.
5,636,481 A 6/1997 De Zen
D380,823 S 7/1997 LaZar
5,651,226 A 7/1997 Archibald
5,672,101 A 9/1997 Thomas
5,697,192 A 12/1997 Inoue
5,697,842 A 12/1997 Donnelly
5,704,834 A * 1/1998 Sells ..... E04D 13/174 52/149
5,706,617 A 1/1998 Hirai et al.
5,722,887 A 3/1998 Wolfson et al.
5,738,581 A 4/1998 Rickert et al.
5,740,636 A 4/1998 Archard
5,746,653 A 5/1998 Palmer et al.
5,746,839 A 5/1998 Dinwoodie
5,766,071 A 6/1998 Kirkwood
D397,431 S 8/1998 Meyer
5,800,631 A 9/1998 Yamada et al.
5,816,909 A 10/1998 Wunder
D403,755 S 1/1999 Liang
5,879,232 A 3/1999 Luter, II et al.
D408,514 S 4/1999 Horng
5,890,322 A 4/1999 Fears
D409,741 S 5/1999 Yuen-Ming
5,968,287 A 10/1999 Nath
5,990,414 A 11/1999 Posnansky
6,005,236 A 12/1999 Phelan et al.
6,008,450 A 12/1999 Ohtsuka et al.
6,036,102 A 3/2000 Pearson
6,050,039 A 4/2000 O'Hagin
6,051,774 A 4/2000 Yoshida et al.
D424,186 S 5/2000 Dodson
D424,672 S 5/2000 Nanjo
6,061,977 A 5/2000 Toyama et al.
6,061,978 A 5/2000 Dinwoodie et al.
6,077,159 A 6/2000 Clayton
6,105,317 A 8/2000 Tomiuchi et al.
6,129,628 A 10/2000 O'Hagin et al.
6,155,006 A 12/2000 Mimura et al.
6,220,956 B1 4/2001 Kilian et al.
D442,273 S 5/2001 Pestell
6,241,602 B1 6/2001 Allen
6,242,685 B1 6/2001 Mizukami et al.
6,243,995 B1 6/2001 Reeves et al.
D444,869 S 7/2001 Yip
6,294,724 B1 9/2001 Sasaoka et al.
6,306,030 B1 10/2001 Wilson
D450,378 S 11/2001 Minakuchi
6,311,436 B1 11/2001 Mimura et al.
6,336,304 B1 1/2002 Mimura et al.
6,340,403 B1 1/2002 Carey et al.

(56) References Cited

U.S. PATENT DOCUMENTS 6,365,824 B1 4/2002 Nakazima et al.
6,380,477 B1 4/2002 Curtin
D457,234 S 5/2002 O'Hagin et al.
D458,391 S 6/2002 O'Haqin et al.
D458,392 S 6/2002 O'Haqin et al.
6,415,559 B1 7/2002 Reeves et al.
6,418,678 B2 7/2002 Rotter
6,439,466 B2 8/2002 Fikes
6,447,390 B1 9/2002 O'Hagin
6,453,629 B1 9/2002 Nakazima et al.
6,459,032 B1 10/2002 Luch
6,491,579 B1 12/2002 O'Hagin
6,501,013 B1 12/2002 Dinwoodie
6,541,693 B2 4/2003 Takada et al.
6,553,729 B1 4/2003 Nath et al.
6,606,830 B2 8/2003 Nagao et al.
D479,885 S 9/2003 O'Hagin et al.
6,695,692 B1 * 2/2004 York ..... E04D 13/0325 454/199
D489,834 S 5/2004 Weston
6,729,081 B2 5/2004 Nath et al.
6,730,841 B2 5/2004 Heckeroth
6,767,762 B2 7/2004 Guha
6,799,742 B2 10/2004 Nakamura et al.
D503,156 S 3/2005 Provenzano
6,870,087 B1 3/2005 Gallagher
D503,790 S 4/2005 Dodge et al.
D504,172 S 4/2005 O'Hagin
6,875,914 B2 4/2005 Guha et al.
D505,195 S 5/2005 Snyder
6,928,775 B2 8/2005 Banister
6,941,706 B2 * 9/2005 Austin ..... E04D 13/004 52/302.3
D512,774 S * 12/2005 O'Hagin ..... E04D 13/17 D23/393
D518,158 S 3/2006 Cho et al.
D519,219 S 4/2006 Dodge et al.
D520,149 S 5/2006 Dodge et al.
7,044,852 B2 5/2006 Horton
7,053,294 B2 5/2006 Tuttle et al.
7,097,557 B2 8/2006 Kutschman
D527,813 S 9/2006 Dodge et al.
D527,836 S 9/2006 O'Hagin
7,101,279 B2 9/2006 O'Hagin et al.
D536,778 S 2/2007 O'Hagin
D537,519 S 2/2007 Sigillo
7,176,543 B2 2/2007 Beernink
7,178,295 B2 2/2007 Dinwoodie
D538,422 S 3/2007 Hooijaaijers et al.
7,250,000 B2 7/2007 Daniels, II
D549,316 S * 8/2007 O'Hagin ..... E04D 13/17 D23/393
D555,237 S 11/2007 O'Hagin
7,320,774 B2 1/2008 Simmons et al.
D562,440 S 2/2008 Negrao et al.
D562,993 S 2/2008 Shepherd et al.
7,365,266 B2 4/2008 Heckeroth
D578,633 S 10/2008 Schluter et al.
D579,096 S 10/2008 Guzorek
D580,542 S 11/2008 Miyake
D582,905 S 12/2008 Takisawa et al.
7,469,508 B2 12/2008 Ceria
7,470,179 B1 12/2008 Ritter et al.
D588,255 S 3/2009 Daniels
D588,256 S 3/2009 Daniels
D589,134 S 3/2009 O'Hagin et al.
7,497,774 B2 3/2009 Stevenson et al.
7,506,477 B2 3/2009 Flaherty et al.
7,507,151 B1 3/2009 Parker et al.
7,509,775 B2 3/2009 Flaherty et al.
7,517,465 B2 4/2009 Guha et al.
7,531,740 B2 4/2009 Flaherty et al.
D593,193 S 5/2009 Jackson
D595,402 S 6/2009 Miyake
7,578,102 B2 8/2009 Banister
D601,237 S 9/2009 Nishio et al.
7,587,864 B2 9/2009 McCaskill et al.
7,618,310 B2 11/2009 Daniels
7,642,449 B2 1/2010 Korman et al.
D610,245 S 2/2010 Daniels
D612,040 S 3/2010 Daniels
7,678,990 B2 3/2010 McCaskill et al.
D618,780 S * 6/2010 Williams, Sr. ..... D23/373
7,736,940 B2 6/2010 Basol
7,757,440 B2 7/2010 Austin et al.
D625,800 S 10/2010 Daniels
7,901,278 B2 3/2011 O'Hagin
8,079,898 B1 12/2011 Stevenson
D654,161 S 2/2012 Holland et al.
8,167,216 B2 5/2012 Schultz et al.
8,292,707 B2 10/2012 Grisham et al.
8,316,592 B2 11/2012 Lanza
D685,112 S 6/2013 Henriquez
D685,113 S 6/2013 Henriquez
8,479,458 B2 7/2013 Morita et al.
8,535,128 B2 9/2013 Chwala
D696,392 S 12/2013 Funnell, II
8,607,510 B2 12/2013 Daniels
8,608,533 B2 12/2013 Daniels
D702,827 S 4/2014 Mase et al.
D703,305 S 4/2014 O'Hagin
8,701,360 B2 4/2014 Ressler
8,740,678 B2 6/2014 Railkar et al.
8,776,455 B2 7/2014 Azoulay
8,782,967 B2 7/2014 Daniels
8,793,943 B2 8/2014 Daniels
D713,953 S 9/2014 Jepson
D719,253 S 12/2014 Francescon
9,011,221 B2 4/2015 Daniels
D748,239 S 1/2016 Daniels
D755,944 S 5/2016 Daniels
D766,413 S 9/2016 Zhou et al.
D768,276 S 10/2016 Kim et al.
D779,650 S 2/2017 Poehlman et al.
D788,281 S 5/2017 Daniels
D788,902 S 6/2017 Daniels
D796,661 S 9/2017 Oswald
D810,257 S 2/2018 Lai
D812,211 S 3/2018 Daniels
D841,797 S 2/2019 Daniels
D891,604 S 7/2020 Daniels
D930,810 S 9/2021 Daniels
2001/0027804 A1 10/2001 Inoue et al.
2001/0040201 A1 11/2001 Paxton
2002/0036010 A1 3/2002 Yamawaki et al.
2002/0104562 A1 8/2002 Emoto et al.
2003/0000158 A1 1/2003 Borges
2003/0159802 A1 8/2003 Steneby et al.
2004/0031219 A1 2/2004 Banister
2004/0098932 A1 5/2004 Broatch
2005/0074915 A1 4/2005 Tuttle et al.
2005/0127379 A1 6/2005 Nakata
2005/0130581 A1 6/2005 Dodge
2005/0144963 A1 7/2005 Peterson et al.
2005/0176270 A1 8/2005 Luch
2005/0178429 A1 8/2005 McCaskill et al.
2005/0191957 A1 9/2005 Demetry et al.
2005/0233691 A1 * 10/2005 Horton ..... E04D 13/17 454/366
2005/0239393 A1 10/2005 Reese
2005/0239394 A1 10/2005 O'Hagin
2005/0263178 A1 12/2005 Montello et al.
2005/0263179 A1 12/2005 Gaudiana et al.
2005/0263180 A1 12/2005 Montello et al.
2005/0274408 A1 12/2005 Li et al.
2006/0017154 A1 1/2006 Eguchi et al.
2006/0032527 A1 2/2006 Stevens et al.
2006/0052047 A1 3/2006 Daniels, II
2006/0052051 A1 3/2006 Daniels
2006/0086384 A1 4/2006 Nakata
2006/0124827 A1 6/2006 Janus et al.
2006/0199527 A1 9/2006 Peters
2006/0223437 A1 * 10/2006 O'Hagin ..... E04D 13/17 454/366

(56) References Cited

U.S. PATENT DOCUMENTS

| | | | | |
|---|---|---|---|---|
| 2007/0049190 | A1* | 3/2007 | Singh | F24F 7/02 454/365 |
| 2007/0066216 | A1 | 3/2007 | McIntire | |
| 2007/0067063 | A1 | 3/2007 | Ahmed | |
| 2007/0072541 | A1 | 3/2007 | Daniels et al. | |
| 2007/0084501 | A1 | 4/2007 | Kalberlah et al. | |
| 2007/0094953 | A1 | 5/2007 | Galeazzo et al. | |
| 2007/0173191 | A1 | 7/2007 | Daniels, II | |
| 2007/0178827 | A1 | 8/2007 | Erni | |
| 2007/0184775 | A1 | 8/2007 | Perkins | |
| 2007/0207725 | A1 | 9/2007 | O'Hagin | |
| 2007/0243820 | A1 | 10/2007 | O'Hagin | |
| 2007/0246095 | A1 | 10/2007 | Schaefer | |
| 2008/0040990 | A1 | 2/2008 | Vendig et al. | |
| 2008/0098672 | A1 | 5/2008 | O'Hagin et al. | |
| 2008/0163576 | A1 | 7/2008 | Oaten | |
| 2008/0220714 | A1 | 9/2008 | Caruso et al. | |
| 2008/0287053 | A1 | 11/2008 | Carlson et al. | |
| 2008/0287054 | A1 | 11/2008 | Carlson et al. | |
| 2008/0299892 | A1 | 12/2008 | Robinson | |
| 2009/0203308 | A1 | 8/2009 | O'Hagin | |
| 2009/0253368 | A1 | 10/2009 | Rotter | |
| 2009/0286463 | A1 | 11/2009 | Daniels | |
| 2009/0311959 | A1 | 12/2009 | Shepherd | |
| 2009/0320381 | A1* | 12/2009 | Gerig | E04D 13/076 52/12 |
| 2010/0064605 | A1 | 3/2010 | Corvaglia et al. | |
| 2010/0068985 | A1 | 3/2010 | Park | |
| 2010/0229940 | A1 | 9/2010 | Basol | |
| 2010/0287852 | A1 | 11/2010 | Bortoletto | |
| 2010/0300128 | A1 | 12/2010 | Chen | |
| 2010/0330898 | A1 | 12/2010 | Daniels | |
| 2011/0294412 | A1 | 12/2011 | Vagedes | |
| 2012/0110924 | A1 | 5/2012 | Makin | |
| 2012/0151856 | A1 | 6/2012 | Azoulay | |
| 2012/0178357 | A1 | 7/2012 | Rheaume | |
| 2012/0190288 | A1 | 7/2012 | Willen | |
| 2012/0252348 | A1 | 10/2012 | Rheaume | |
| 2012/0322359 | A1 | 12/2012 | Chen et al. | |
| 2013/0019548 | A1 | 1/2013 | Daniels | |
| 2013/0040553 | A1 | 2/2013 | Potter | |
| 2013/0078903 | A1 | 3/2013 | Mantyla et al. | |
| 2013/0247480 | A1 | 9/2013 | Ridgway | |
| 2014/0065944 | A1 | 3/2014 | Chamness | |
| 2014/0099878 | A1 | 4/2014 | Daniels | |
| 2014/0248834 | A1 | 9/2014 | Kolt et al. | |
| 2015/0143760 | A1 | 5/2015 | Daniels | |
| 2015/0253021 | A1 | 9/2015 | Daniels | |
| 2018/0216845 | A1* | 8/2018 | Whitehead | F24F 13/10 |

FOREIGN PATENT DOCUMENTS

| | | |
|---|---|---|
| GB | 2183819 | 6/1987 |
| GB | 2279453 | 1/1995 |
| GB | 2345536 | 7/2000 |
| JP | 59-060138 | 4/1984 |
| JP | H06 13304 U | 2/1994 |
| JP | 06-241517 | 8/1994 |
| JP | 06-272920 | 9/1994 |
| JP | 09-158428 | 6/1997 |
| JP | 10-061133 | 3/1998 |
| JP | 11-044035 | 2/1999 |
| JP | 11-229576 | 8/1999 |
| JP | 2000-274032 | 10/2000 |
| JP | 2002/357344 | 12/2002 |
| JP | 2004-092298 | 3/2004 |
| JP | 2007-534924 | 11/2007 |
| WO | WO 05/108708 | 11/2005 |
| WO | WO 2013/106882 | 7/2013 |

OTHER PUBLICATIONS

International Search Report for PCT/US2014/060964 dated Jan. 29, 2015.

Flat-Type Vent. Formfomts.com[online] 1 page. Designed/built 2008 [retrieved on Feb. 12, 2015]. <https://www.formfonts.com/3D-Model/11 030/1 /b3020-roof-openings/b3020-roof-openings/b3020-roof-openings/b3020-roof-openings/b3020-roof- openings/ohagins-concrete-tile-vent-type-flatl>.

Roof Vents. (1/8-Designs-© Questel). orbit.com [online PDF] 27 pages. Uploaded 2014 [retrieved on Feb. 12, 2015]. Retrieved from I nternet: <http://sobjprd.questel.fr/exportlQPTUJ214/pdf2/5f7850ea-f617 -4548-bc4 7 -08c3edb41caO-222833.pdf>.

S-Type Vent. Formfomts.com[online] 1 page. Designed/built 2008 [retrieved on Feb. 12, 2015]. <http://www.formfonts.com/3D-Model/11 032/shell/b30-roofing/b301 0-roof-coverings/b3020-roof-openings/ohagins-concrete-tile-vent-type/>.

M-Type Vent. Formfomts.com[online] 1 page. Designed/built 2008 [retrieved on Feb. 12, 2015]. <https://www.formfonts.com/3D-Model/1 /11031/1 /shell/b30-roofing/b301 0-roof-coverings/b3020-roof-openings/ohagins-concrete-tile-vent-type-config/.

* cited by examiner

| Diverter | Test Conditions | Results |
|---|---|---|
| 1/2 in at 90° | Wind Speed: 70 mph<br>Water Spray: On<br>Duration: 3 min | Wind Speed: No Shingle or vent displacement<br>Water Spray: Water infiltration |
| | Wind Speed: 0 mph<br>Water Spray: Off<br>Duration: 5 min | Wind Speed: No Shingle or vent displacement<br>Water Spray: Water infiltration<br>Note: Test suspended due to asphalt shingle uplift. Mike Fulton terminated test on account of significant water infiltration |
| 1/2 in at 45° | Wind Speed: 70 mph<br>Water Spray: On<br>Duration: 15 min | Wind Speed: No Shingle or vent displacement<br>Water Spray: Water infiltration evident |
| | Wind Speed: 0 mph<br>Water Spray: Off<br>Duration: 5 min | Wind Speed: No Shingle or vent displacement<br>Water Spray: 4720ml Water collected |
| 1 in at 90° | Wind Speed: 70 mph<br>Water Spray: On<br>Duration: 15 min | Wind Speed: No Shingle or vent displacement<br>Water Spray: Water infiltration evident |
| | Wind Speed: 0 mph<br>Water Spray: Off<br>Duration: 5 min | Wind Speed: No Shingle or vent displacement<br>Water Spray: 60ml Water collected |
| 1 in at 45° | Wind Speed: 70 mph<br>Water Spray: On<br>Duration: 15 min | Wind Speed: No Shingle or vent displacement<br>Water Spray: Water infiltration evident |
| | Wind Speed: 0 mph<br>Water Spray: Off<br>Duration: 5 min | Wind Speed: No Shingle or vent displacement<br>Water Spray: 260ml Water collected |
| 1-1/2 in at 90° | Wind Speed: 70 mph<br>Water Spray: On<br>Duration: 15 min | Wind Speed: No Shingle or vent displacement<br>Water Spray: Water infiltration evident |
| | Wind Speed: 0 mph<br>Water Spray: Off<br>Duration: 5 min | Wind Speed: No Shingle or vent displacement<br>Water Spray: 6ml Water collected |
| 1-1/2 in at 45° | Wind Speed: 70 mph<br>Water Spray: On<br>Duration: 15 min | Wind Speed: No Shingle or vent displacement<br>Water Spray: Water infiltration evident |
| | Wind Speed: 0 mph<br>Water Spray: Off<br>Duration: 5 min | Wind Speed: No Shingle or vent displacement<br>Water Spray: 1ml Water collected |

FIG. 4A

| Interval | Test Conditions | Results |
|---|---|---|
| 1 | Wind Speed: 35 mph<br>Water Spray: On<br>Duration: 15 min | Wind Speed: No Vent displacement<br>Water Spray: No Water infiltration |
| 2 | Wind Speed: 70 mph<br>Water Spray: Off<br>Duration: 3 min | Wind Speed: No Vent displacement<br>Water Spray: No Water infiltration |
| 3 | Wind Speed: 70 mph<br>Water Spray: On<br>Duration: 3 min | Wind Speed: No Vent displacement<br>Water Spray: No Water infiltration |
| 4 | Wind Speed: 70 mph<br>Water Spray: Off<br>Duration: 3 min | Wind Speed: No Vent displacement<br>Water Spray: No Water infiltration |
| 5 | Wind Speed: 70 mph<br>Water Spray: On<br>Duration: 3 min | Wind Speed: No Vent displacement<br>Water Spray: No Water infiltration |
| 6 | Wind Speed: 70 mph<br>Water Spray: Off<br>Duration: 3 min | Wind Speed: No Vent displacement<br>Water Spray: No Water infiltration |
| 7 | Wind Speed: 70 mph<br>Water Spray: On<br>Duration: 3 min | Wind Speed: No Vent displacement<br>Water Spray: No Water infiltration |
| 8 | Wind Speed: 70 mph<br>Water Spray: Off<br>Duration: 3 min | Wind Speed: No Vent displacement<br>Water Spray: No Water infiltration |

FIG. 4B

ROOF VENT AND ROOF VENTILATION SYSTEM

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

This application relates generally to roof vents for buildings, and specifically to roof vents that include diverters.

Description

Ventilation of a building has numerous benefits for both the building and its occupants. For example, ventilation of an attic space can prevent the attic's temperature from rising to undesirable levels, which can also reduce the cost of cooling the interior living space of the building. In addition, increased attic ventilation tends to reduce humidity within the attic, which can prolong the life of lumber used in the building's framing and elsewhere by diminishing the incidence of mold and dry-rot. Moreover, ventilation promotes a healthier environment for residents of the building by encouraging the introduction of fresh, outside air. These and other benefits tend to compound as ventilation increases.

SUMMARY

For purposes of summarizing the invention and the advantages achieved over the prior art, certain objects and advantages of the invention have been described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

In a first aspect, a roof vent is disclosed that includes a lower portion configured to be installed on a roof deck, the lower portion including an opening extending therethrough. The roof vent also includes an upper portion attached to the lower portion at an upslope edge, the upper portion spaced apart from the lower portion at a downslope edge to create a space between the upper portion and the lower portion, the space bounded by side walls on lateral edges. The roof vent also includes a front opening between the lower portion and the upper portion at a downslope edge of the upper portion, the front opening allowing airflow into and out of the space. The roof vent also includes an integrated diverter positioned downslope of the front opening and attached to the lower portion, the integrated diverter having a height of at least one inch.

The roof vent can include one or more of the following features, in any combination: (a) wherein the integrated diverter extends at an angle $\alpha$ from the lower portion of the roof vent; (b) wherein the integrated diverter comprises a first portion extending at the angle $\alpha$ from the lower portion of the roof vent, and a second portion extending from the first portion at an angle $\alpha 2$; (c) wherein the angle $\alpha$ is approximately 90 degrees; (d) wherein the integrated diverter comprises a curved portion extending from the lower portion of the roof vent; (e) wherein the integrated diverter extends continuously across the front opening of the roof vent; (f) wherein the integrated diverter comprises a non-continuous diverter including a first diverter portion spaced from a second diverter portion across a width of the diverter; (g) one or more cutouts spaced between the first and the second diverter portions, wherein the one or more cutouts are configured to allow access to a crimping tool used during manufacture of the roof vent; (h) wherein the roof vent is configured to mimic the appearance of a flat tile, an S-shaped tile, or an M-shaped tile; (i) wherein the upper portion angles away from the upslope edge to create the space between the upper portion and the lower portion such that the roof vent comprises a tapered vent; and/or (j) at least one of a solar panel and a fan.

In another aspect, a roof vent system is disclosed that includes a roof vent comprising a lower portion configured to be installed on a roof deck, the lower portion including an opening extending therethrough, an upper portion attached to the lower portion at an upslope edge, the upper portion spaced apart from the lower portion at a downslope edge to create a space between the upper portion and the lower portion, the space bounded by side walls on lateral edges, and a front opening between the lower portion and the upper portion at a downslope edge of the upper portion, the front opening allowing airflow into and out of the space. The system also includes a diverter configured to be positioned downslope of the front opening of the roof vent when installed, the diverter having a height of at least one inch and no more than 1.75 inches.

The system can include one or more of the following features, in any combination: (a) wherein the diverter comprises a height, and wherein the diverter is configured to be positioned at least a distance that is equal to the height of the diverter downslope of the front opening; (b) wherein the diverter extends continuously across the front opening of the roof vent; (c) wherein the diverter comprises a non-continuous diverter including a first diverter portion spaced from a second diverter portion across a width of the diverter; (d) one or more cutouts spaced between the first and the second diverter, wherein the one or more cutouts are configured to allow access to a crimping tool used during manufacture of the roof vent; (e) wherein the roof vent is configured to mimic the appearance of a flat tile, an S-shaped tile, or an M-shaped tile; and/or (f) wherein the upper portion angles away from the upslope edge to create the space between the upper portion and the lower portion such that the roof vent comprises a tapered vent.

In another aspect, a roof vent is disclosed that includes a lower portion configured to be installed on a roof deck, the lower portion including an opening extending therethrough. The roof vent also includes an upper portion attached to the lower portion at an upslope edge, the upper portion spaced apart from the lower portion at a downslope edge to create a space between the upper portion and the lower portion, the space bounded by side walls on lateral edges. The roof vent also includes a front opening between the lower portion and the upper portion at a downslope edge of the upper portion, the front opening allowing airflow into and out of the space. The roof vent also includes a diverter configured such that water infiltration through the vent is below 60 mL when the vent is tested according to the Testing Application Standard (TAS) No. 100-95.

The roof vent may include one or more of the following features, in any combination: (a) wherein the diverter extends continuously across the front opening of the roof vent; (b) wherein the diverter comprises a non-continuous diverter including a first diverter portion spaced from a second diverter portion across a width of the diverter; (c) one or more cutouts spaced between the first and the second diverter, wherein the one or more cutouts are configured to allow access to a crimping tool used during manufacture of the roof vent; (d) wherein the roof vent is configured to mimic the appearance of a flat tile, an S-shaped tile, or an M-shaped tile; and/or (e) wherein the upper portion angles away from the upslope edge to create the space between the upper portion and the lower portion such that the roof vent comprises a tapered vent.

In another aspect, a roof vent is disclosed that includes a lower portion configured to be installed on a roof deck, the lower portion including an opening extending therethrough. The roof vent also includes an upper portion attached to the lower portion at an upslope edge, the upper portion spaced apart from the lower portion at a downslope edge to create a space between the upper portion and the lower portion, the space bounded by side walls on lateral edges. The roof vent also includes a front opening between the lower portion and the upper portion at a downslope edge of the upper portion, the front opening allowing airflow into and out of the space. The roof vent also includes a diverter configured such that no substantial amount of water enters the vent through the front opening during wet conditions and wind speeds of at least 50 mph.

The roof vent can include one or more of the following features, in any combination: (a) wherein the diverter extends continuously across the front opening of the roof vent; (b) a non-continuous diverter including a first diverter portion spaced from a second diverter portion across a width of the diverter; (c) comprising one or more cutouts spaced between the first and the second diverter, wherein the one or more cutouts are configured to allow access to a crimping tool used during manufacture of the roof vent; (d) wherein the diverter is integrated with the lower portion of the roof vent; (e) wherein the roof vent is configured to mimic the appearance of a flat tile, an S-shaped tile, or an M-shaped tile; and/or (f) wherein the upper portion angles away from the upslope edge to create the space between the upper portion and the lower portion such that the roof vent comprises a tapered vent.

In another aspect, a roof ventilation system is disclosed. The system can include a first attic area requiring a minimum amount of ventilation as defined by building code, a first plurality of vents positioned on or within said area, and a second plurality of vents positioned on or within said area. The second plurality of vents can be positioned at a higher elevation than the first plurality of vents, and the NFVA of at least one of the second plurality of vents can be greater than the NFVA of at least one of the first plurality of vents. In some embodiments, any of the first and/or second plurality of vents can be any of the vents described herein, including vents with diverters. In some embodiments, the system can further include a second attic area defined by building code, with a firewall separating the first attic area from the second attic area.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

The features and advantages of the roof vents and methods described herein will become more fully apparent from the following description and appended claims, taken in conjunction with the accompanying drawings. These drawings depict only several embodiments in accordance with the disclosure and are not to be considered limiting of its scope. In the drawings, similar reference numbers or symbols typically identify similar components, unless context dictates otherwise. In some instances, the drawings may not be drawn to scale.

FIG. 4A is a table presenting wind and wind-driven rain testing results for roof vents as shown in FIGS. 3A and 3B with several different diverter embodiments.

FIG. 4B is a table presenting wind and wind-driven rain testing results for a roof vent as shown in FIGS. 3A and 3B with an embodiment of diverter that is one and half inches tall and angled at 45 degrees.

FIG. 6A is an isometric top view of an embodiment of a flat roof vent that includes an embodiment of a diverter.

FIG. 6B is an isometric bottom view of the flat roof vent of FIG. 6A.

FIG. 6C is a side view of the flat roof vent of FIG. 6A.

FIG. 6D is an isometric top view of an embodiment of the flat roof vent of FIG. 6A that includes an embodiment of a non-continuous diverter.

FIG. 6E is an isometric top view of an embodiment of the flat roof vent of FIG. 6A that includes an embodiment of a solar panel.

FIG. 6F is an isometric bottom view of an embodiment of the flat roof vent of FIG. 6A that includes an embodiment of a fan.

FIG. 6G is an exploded view of the flat roof vent of FIG. 6F.

FIG. 6H is an exploded view of an embodiment of the flat roof vent of FIG. 6A that includes an embodiment of a fan that includes a flange.

FIG. 7A is an isometric top view of an embodiment of an S-shaped roof vent that includes an embodiment of a diverter.

FIG. 7B is an isometric bottom view of the S-shaped roof vent of FIG. 7A.

FIG. 7C is a side view of the S-shaped roof vent of FIG. 7A.

FIG. 7D is an isometric top view of an embodiment of the S-shaped roof vent of FIG. 7A that includes an embodiment of a non-continuous diverter.

FIG. 7E is a top exploded view of an embodiment of the S-shaped roof vent of FIG. 7A that includes an embodiment of a fan.

FIG. 7F is an isometric bottom view of the S-shaped roof vent of FIG. 7E.

FIG. 7G is a top exploded view of an embodiment of the S-shaped roof vent of FIG. 7A that includes an embodiment of a solar panel.

FIG. 7H is a top exploded view of an embodiment of the S-shaped roof of FIG. 7A that includes another embodiment of a solar panel.

FIG. 7I is a top exploded view of an embodiment of the S-shaped roof vent of FIG. 7A that includes another embodiment of a solar panel.

FIG. 8A is an isometric top view of an embodiment of an M-shaped roof vent that includes an embodiment of a diverter.

FIG. 8B is an isometric bottom view of the M-shaped roof vent of FIG. 8A.

FIG. 8C is a side view of the M-shaped roof vent of FIG. 8A.

FIG. 8D is an isometric top view of an embodiment of the M-shaped roof vent of FIG. 8A that includes an embodiment of a non-continuous diverter.

FIG. 8E is a top exploded view of an embodiment of the M-shaped roof vent of FIG. 8A that includes an embodiment of a fan.

FIG. 8F is a bottom exploded view of the M-shaped roof vent of FIG. 8E

FIG. 8G is a top exploded view of an embodiment of the M-shaped roof vent of FIG. 8A that includes an embodiment of a solar panel.

FIG. 8H is a top exploded view of an embodiment of the M-shaped roof vent of FIG. 8A that includes another embodiment of a solar panel.

FIG. 8I is a top exploded view of an embodiment of the M-shaped roof vent of FIG. 8A that includes another embodiment of a solar panel.

DETAILED DESCRIPTION

The following discussion presents detailed descriptions of the several embodiments of roof vents and methods shown in the figures. These embodiments are not intended to be limiting, and modifications, variations, combinations, etc., are possible and within the scope of this disclosure.

Figure 1:
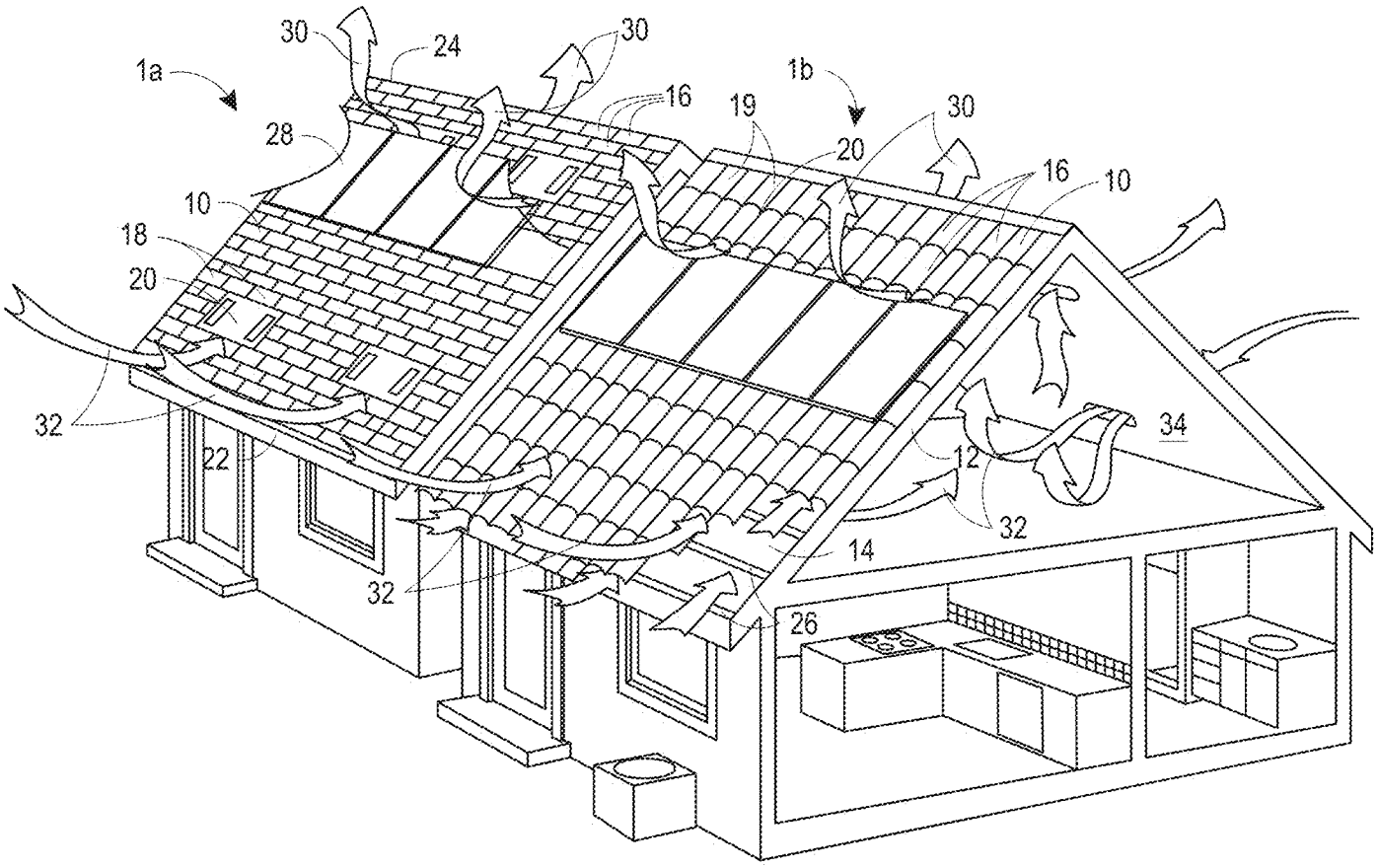
FIG. 1 shows two embodiments of buildings including example ventilation systems and illustrates certain ventilation principles according to those embodiments.

FIG. 1 shows two embodiments of buildings 1*a*, 1*b* including example ventilation systems. In the illustrated embodiments, the buildings 1*a*, 1*b* are residential homes, but the illustrated ventilation systems can be used or adapted for use on many other types of buildings, including both residential and commercial buildings. In the illustrated embodiments, each of the buildings 1*a*, 1*b* include an exemplary roof 10 comprising a roof frame 12 (illustrated for building 1*b*), a roof deck 14 supported on the roof frame 12 (illustrated for building 1*b*), and a layer of roof cover elements 16. The roof deck 14 may typically comprise plywood, metal, or some type of alloy (e.g., steel) sheeting. The layer of roof cover elements 16 may include various types of shingles 18 and/or tiles 19 and various types of vents 20.

In the illustrated example, the building 1*a* includes a roof 10 having a plurality of roof cover elements 16 that comprise shingles 18. In the illustrated embodiment of the building 1*a*, the shingles 18 comprise generally flat and rectangular shapes, although other shapes for the shingles 18 are possible. In general, the shingles 18 are laid in rows from the bottom edge or eave 22 of the roof 10 up towards the apex 24 of the roof 10, with each successive row partially overlapping the row below. In some embodiments, the shingles 18 are made of various materials such as wood, stone, metal, plastic, composite materials (such as asphalt shingles), etc. The shingles 18 can be laid on the roof deck 14. One or more layers of material, such as waterproofing materials and moisture barriers, can be interposed between the shingles 18 and the roof deck 14.

In the illustrated embodiment of the building 1*b*, the roof 10 includes a plurality of roof cover elements 16 that comprise tiles 19. In this embodiment, the tiles 19 comprise a wavy or undulating shape. In such embodiments, the tiles 19 can comprise so called "S-shaped" or "M-shaped" tiles. Other shapes for the tiles 19, including flat tiles, are also possible. In general, the tiles 19 are laid in rows from the bottom edge or eave 22 of the roof 10 up towards the apex 24 of the roof 10, with each successive row partially overlapping the row below. In some embodiments, the tiles 19 are made of materials such as clay, stone, metal, plastic, composite materials (such as concrete), etc.

In the illustrated embodiment of the building 1*b*, the roof 10 includes a plurality of purlins or battens 26. The battens 26 can be positioned on the roof deck 14 so as to extend substantially parallel to the eaves 22 and ridge or apex 24 of the roof 10 and substantially perpendicular to rafters (not shown) that support the roof deck 14. The tiles 19 can be installed over the battens 26, and the battens 26 can space the tiles 19 above the roof deck 14 to create a space between the roof deck 14 and the tiles 19. In the illustrated roof 10 of the building 1*b*, each batten 26 directly supports an upper edge of a tile 19, which in turn supports a lower edge of an immediately adjacent tile 19. In this arrangement, water tends to flow over each tile's lower edge onto another tile 19. One or more layers of material, such as waterproofing materials and moisture barriers, can be interposed between the tiles 19 and the roof deck 14.

As illustrated, the layer of roof cover elements 16 for each of the buildings 1*a*, 1*b* can also include one or more vents 20. In general, the vents 20 are configured to allow airflow therethrough. For example, the vents 20 can be configured to allow airflow from a region above the vents 20 to a region below the vents 20 or vice versa. As illustrated in FIG. 1, the vents 20 can be configured to allow ventilation of air to and from the buildings 1*a*, 1*b*. For example, as illustrated by arrows 30, the vents 20 can permit ventilation of air from the buildings 1*a*, 1*b*. Additionally, in some embodiments, the vents 20 can allow outside air to flow into the buildings 1*a*, 1*b*. For example, as illustrated by arrows 32, the vents 20 can permit air from outside of the buildings 1*a*, 1*b* to flow into the interior of the buildings 1*a*, 1*b*. Several embodiments of example vents 20 will be described in greater detail below.

The vents 20 can provide a ventilation system for the building 1*a*, 1*b*. The ventilation system can provide numerous benefits. For example, the ventilation system can remove hot air from within the building 1*a*, 1*b*. In many instances, hot air can build up within an attic 34. The vents 20 can allow this hot air to escape. This can cool the buildings 1*a*, 1*b*. Additionally, this may conserve energy, as it may reduce or eliminate the need for powered cooling systems, such as air conditioners. Further, the ventilations systems can remove trapped gases from within the buildings 1*a*, 1*b*. Proper ventilation facilitates the removal of hot, trapped gasses and fumes, which are a major cause of indoor air pollution, allergies, and other health related problems. The ventilations systems can also reduce moisture buildup within the buildings 1*a*, 1*b*, which can reduce the likelihood of mold, mildew, and other health concerns, as well as increase the lifespan of building materials (e.g., lumbar and others) used to construct the home. Finally, proper ventilations systems can extend the life of the roof 10. Other benefits and advantages of ventilation systems are possible.

In some embodiments, the ventilation systems can be passive. That is, in some embodiments, the vents 20 are not powered. In other embodiments, the ventilation systems can be active, for example, including one or more powered fans or other components for driving airflow.

As illustrated, the roofs 10 can optionally include one or more solar panels 28. The solar panels 28 can be used to power a variety of different types of devices, such as ventilation fans, motorized vent doors, and the like. The solar panels 28 can alternatively or additionally be used simply to collect power (in the form of solar energy) that can be stored in a battery for later use. In some municipalities, the solar panels 28 can even deliver energy into the community's electrical grid, often in exchange for reduced electrical bills. As illustrated, for example, on the building 1*a*, in some embodiments, the vents 20 can be installed below or partially below the solar panels 28. This can facilitate cooling of the solar panels 28, which may increase their efficiency.

As shown in FIG. 1, in some embodiments, the roof vents 20 can be adapted to mimic the appearance of the roof cover elements 16 that surround them. For example, on the building 1*a*, which includes flat shingles 18, the vents 20 are configured to have flat surfaces. On the building 1*b*, which includes curved tiles 19, the vents 20 are configured to have a corresponding curved shape. Vents 20 that mimic the appearance of the other roof cover elements 16 (e.g., the shingles 18 or tiles 19) may be aesthetically desirable.

Figure 2A:
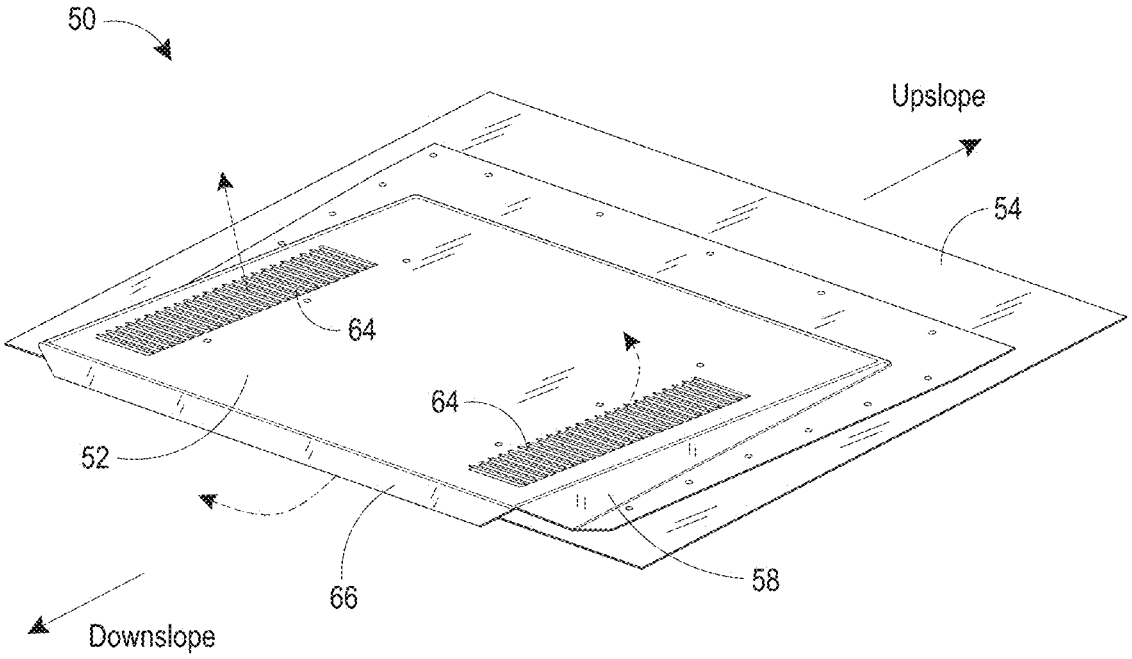
FIG. 2A illustrates an isometric view of an embodiment of a roof vent.
Figure 2B:
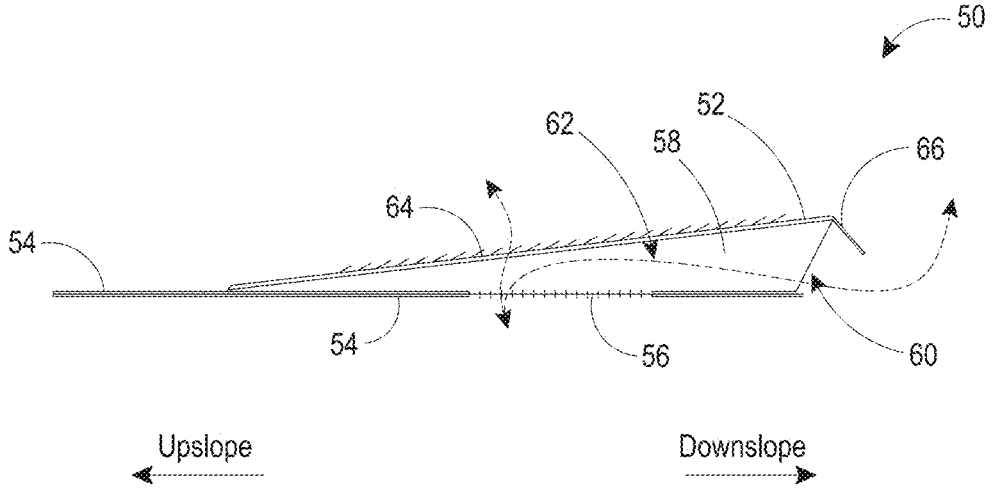
FIG. 2B illustrates a cross-sectional view of the roof vent of FIG. 2A.

FIGS. 2A and 2B illustrate an embodiment of a roof vent 50. The vent 50 illustrated in FIGS. 2A and 2B may be similar to the vents 20 illustrated on the roof 10 of the building 1*a* in FIG. 1. FIG. 2A illustrates a top isometric view of the vent 50, and FIG. 2B illustrates a cross-sectional view of the vent 50. In some embodiments, the vent 50 may be considered a "tapered composition vent," because of its generally tapered shape (see FIG. 2B).

As illustrated, the vent 50 includes an upper portion 52 and a lower portion 54. The lower portion 54 can, in some embodiments, comprise a generally flat sheet configured to be installed on a roof deck 14 (see FIG. 1). The lower portion 54 can include an opening or aperture 56 (see FIG. 2B) configured to allow airflow there through. In FIGS. 2A and 2B, airflow through the vent 50 is illustrated with dashed arrows. As shown in FIG. 2B, the opening 56 may be covered with a grate or screen to prevent or reduce the likelihood that solid objects (e.g., leaves or other debris) will pass through the vent 50. When the vent 50 is installed, the opening 56 may be aligned with a corresponding opening or aperture formed in the roof deck 14 (not shown).

The tapered design of the vent 50 may advantageously increase the velocity of air flowing through the vent 50 into the building, as the tapered top acts as a kind of nozzle or flow restrictor on the air inducted into the vent. It will be appreciated that air flow into the building can occur naturally or can be assisted by using a fan assembly (e.g., FIG. 3F) that draws air into the building rather than exhausts air therefrom.

The upper portion 52 of the vent 50 can be attached (either permanently or removably) to the upper side of the lower portion 54. In some embodiments, the upper portion 52 is not directly attached to the lower portion 54, and/or is spaced from the lower portion 54. For example, in some embodiments, the lower portion 54 is attached to a roof deck and the upper portion 52 is positioned on or within a field of roof cover elements positioned above the roof deck. In some embodiments, the lower portion 52 can be considered a primary vent member and the upper portion 54 can be considered a secondary vent member as described further below with reference to FIG. 6H.

In the illustrated embodiment of FIGS. 2A and 2B, the upper portion 52 includes a tapered shape. For example, on the upslope side of the vent 50 (i.e., the side that would be positioned at a higher elevation when installed, e.g., towards the apex 24 of the roof 10; FIG. 1), the upper portion 52 is joined to the lower portion 54. Moving towards the downslope side of the vent 50 (i.e., the side that would be positioned at a lower elevation when installed, e.g., towards the eaves 22 of the roof 10), the upper portion is angled away from the lower portion 54, creating a tapered shape. Side walls 58 join lateral edges of the upper portion 52 and the lower portion 54. On the downslope side of the vent 50, an opening 60 (see FIG. 2B) is formed between the upper portion 52 and the lower portion 54. The opening 60 allows airflow from the exterior of the vent into and out of a cavity or space 62 created between the upper portion 52 and the lower portion 54.

The upper portion 64 can also include a plurality of louvers that further allow airflow into and out of the space 62 between the upper portion 52 and the lower portion 54. As best shown in FIG. 2B, the louvers 64 may be angled toward the downslope side of the vent 50. As shown in FIG. 2A, the louvers 64 may be arranged in rows extending along lateral edges of the upper portion 52. In some embodiments, the louvers 64 are not positioned directly over the opening 56 in the lower portion 54. For example, the opening 56 of the lower portion 54 may be positioned between the two rows of louvers 64. This may prevent any water that enters the vent 50 through the louvers 64 from passing through the vent 50. For example, water that enters the louvers 64 will contact the upper side of the lower portion 54 and then run out of the vent through the opening 60, rather than entering through the opening 56.

The downslope edge of the upper portion 52 may include an angled flange 66 as shown. The angled flange 66 may help to protect the opening 60. For example, the angled flange 66 may partially extend over the opening 60 in an effort to prevent water and other debris from being driving into the space 62. In general, when installed, the roof vent 50 is positioned so that water and other debris on the roof runs down the roof's slope and away from the opening 60. However, in some instances, other forces, such as wind, can undesirably drive water or other debris back up the roof slope under the angled flange 66 and into the vent. In some embodiments, a vent can include a diverter (for example, as shown in FIGS. 3A and 3B) that is configured to prevent or reduce the likelihood that wind or other forces can drive water or other debris through the downslope opening in the vent, while still providing sufficient airflow through the vent.

Figure 3A:
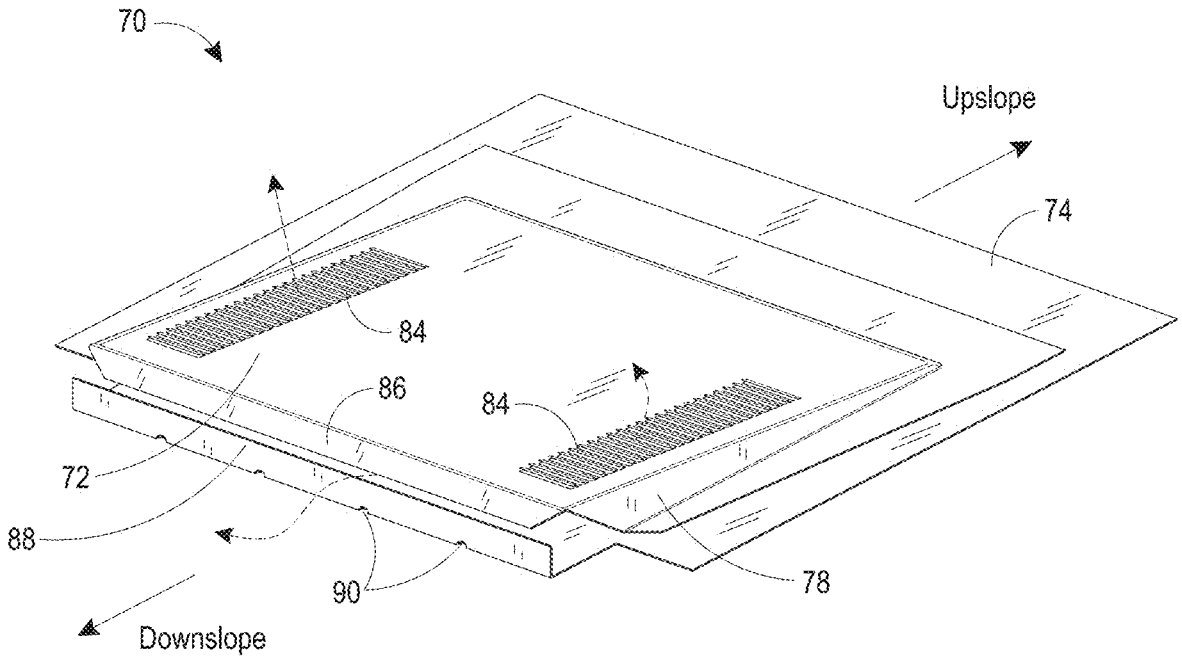
FIG. 3A illustrates an isometric view of an embodiment of a roof vent that includes a diverter.
Figure 3B:
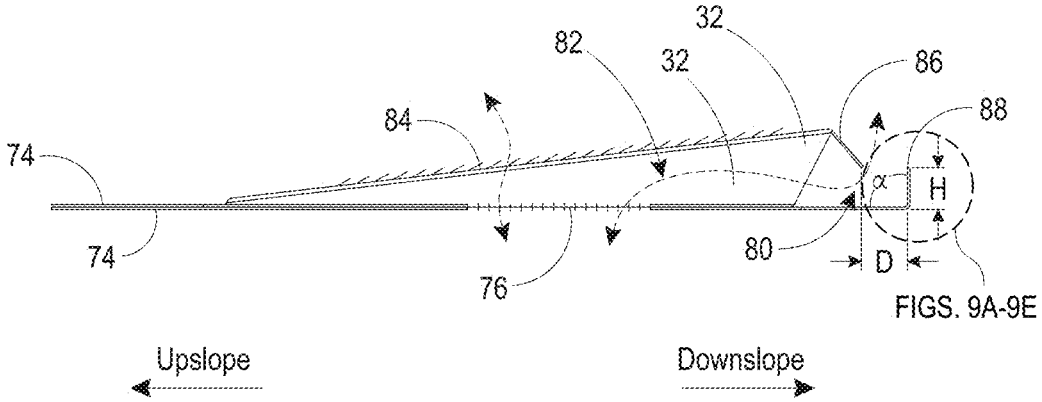
FIG. 3B illustrates a cross-sectional view of the roof vent of FIG. 3A.

FIGS. 3A and 3B illustrate views of an embodiment of a roof vent 70 that includes a diverter 88. FIG. 3A is an isometric top view of the vent 70. and FIG. 3B is a cross-sectional view of the vent 70. As will be described in more detail below, the vent 70 includes the diverter 88. Diverter 88 and others described herein can be configured to prevent or reduce the likelihood that wind or other forces can drive water or other debris through the downslope opening of the vents (e.g., opening 80 in the vent 70), and/or for aesthetic purposes.

Apart from the diverter 88, the roof vent 70 of FIGS. 3A and 3B is in many respects similar to the roof vent 50 previously described. For example, the vent 70 includes an upper portion 72 and a lower portion 74 having an opening 76, sidewalls 78, a front opening 80, and a space 82, and can have louvers 84 and an angled flange 86, which can be similar to related features of the vent 50 previously described. In some embodiments, the vent 70 can also be considered a tapered composition vent. The vent 70 can allow airflow therethrough along the paths illustrated with dashed arrows in the figures.

Unlike the vent 50, the vent 70 of FIGS. 3A and 3B also includes the diverter 88. As illustrated, the diverter 88 may comprise a flange, lip, or upstand which extends upward (e.g., generally away from the roof deck 14 when the vent 70 is installed) to at least partially obstruct access to the front opening 80 of the vent 70. The diverter 88 is generally configured so as to prevent or reduce the likelihood that water or other debris can enter the front opening 80 of the vent 70, while still allowing sufficient airflow through vent 70. The diverter 88 can provide a barrier that reduces or restricts access to the front opening 80 along the surface of the roof. The diverter 88 may comprise various profiles. FIGS. 9A-9E provide detailed views of several example profiles for the diverter 88 and are described in greater detail further below. It will be appreciated that the example diverter profiles of FIGS. 9A-9E can be included on any of the vents described herein. Further, the diverter profiles of FIGS. 9A-9E only illustrate certain examples, and other profiles and variations thereof are also possible and within the scope of this disclosure.

Figure 5A:
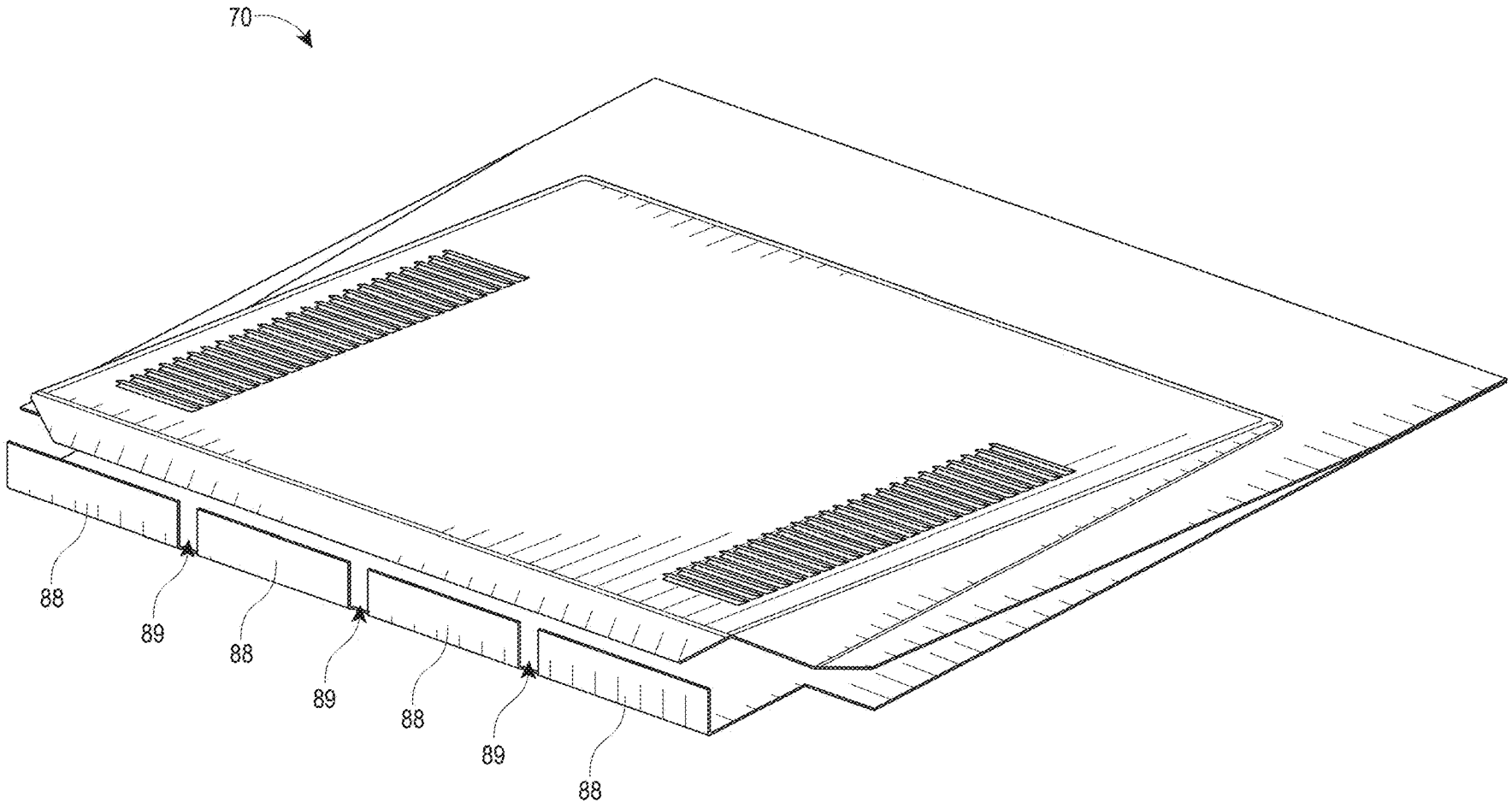
FIG. 5A illustrates an isometric view of an embodiment of the roof vent of FIG. 3A that includes a non-continuous diverter.
Figure 5B:
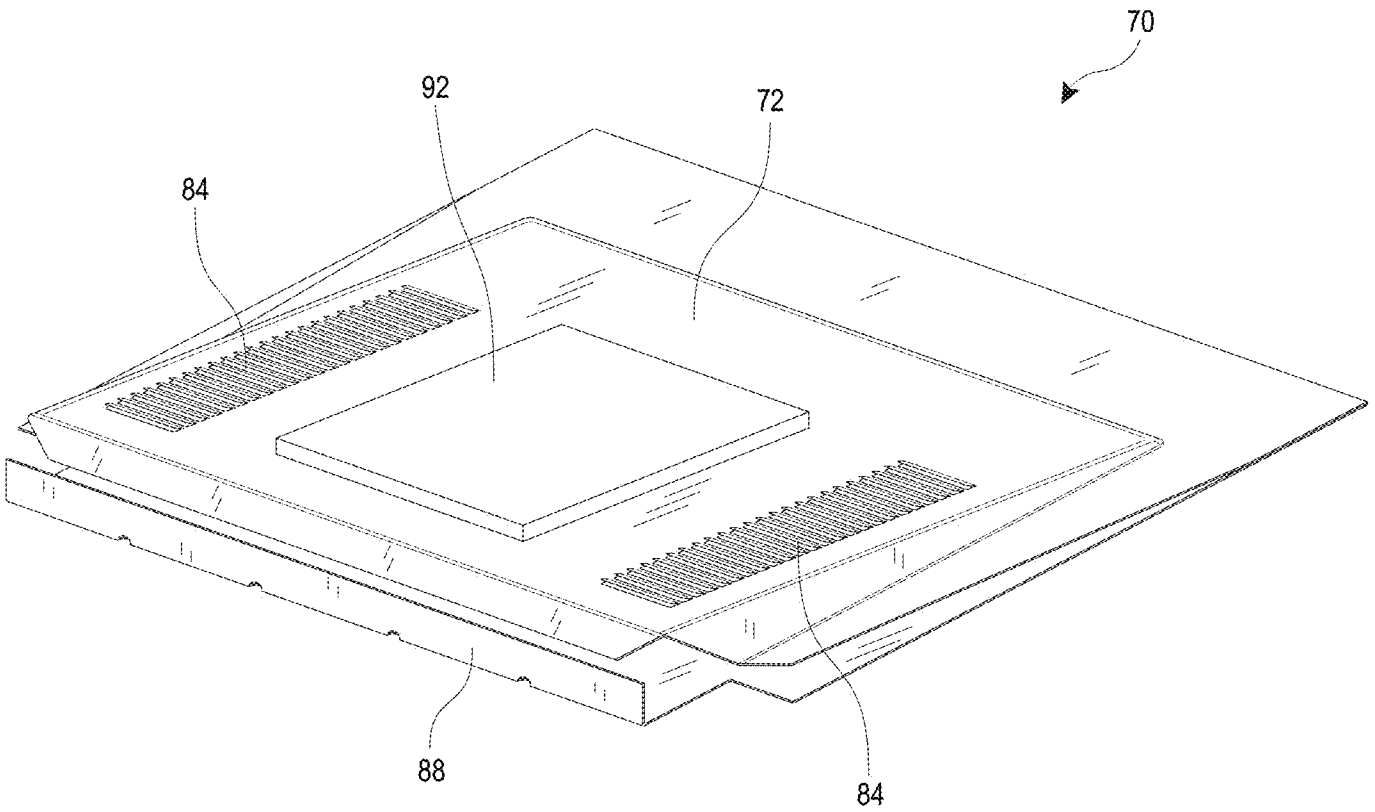
FIG. 5B illustrates an isometric view of an embodiment of the roof vent of FIG. 3A that includes an embodiment of a solar panel.

In some embodiments, the diverter 88 can extend substantially continuously and across substantially the entirety of the width of the opening 80 of the vent 70 as shown, or can extend partially or intermittently across the width of the vent 70. For example, the diverter 88 can include two or more spaced portions across its width, with gaps therebetween (e.g., cutouts), as described further herein (e.g., as shown in FIG. 5B), to form spaces such that the diverter 88 extends non-continuously, i.e., intermittently, across the width of the vent 70. Such spaces can provide aesthetic benefits, and/or can provide access into the gap formed between the diverter and the remainder of the vent 70, for example, for debris removal or to facilitate manufacturing of the vent (e.g., to allow tool access).

In some embodiments, the diverter 88 is integrally formed with the vent 70. For example, as illustrated in FIGS. 3A and 3B, the diverter 88 is integrally formed with the lower portion 74. In some embodiments, the diverter 88 is formed by bending a flange of the lower portion 74 that extends from a downslope side of the vent 70 such that it forms the upstand of the diverter 88. In other embodiments, the diverter 88 can be formed as a separate piece that can be attached to another portion of the vent 70 or directly to the roof deck 14. As best seen in FIG. 3A, in some embodiments, the diverter 88 can include drainage openings 90. The drainage openings 90 can be formed as small holes at the base of the diverter 88 that are configured to allow water to drain through the diverter 88 and down the slope of the roof. The drainage openings 90 can be sufficiently small, such that water driven by the wind is unlikely to significantly pass through the drainage openings 90.

As shown in FIG. 3B, the diverter 88 may comprise a height H. The height H can comprise, for example, about, at least about, or no greater than 0.25 inches, 0.5 inches, 0.75 inches, 1.0 inches, 1.25 inches, 1.5 inches, 1.75 inches, 2.0 inches, 2.25 inches, 2.5 inches, 2.75 inches, 3.0 inches, 3.25 inches, 3.5 inches, 3.75 inches, 4.0 inches, 4.25 inches, 4.5 inches, 4.75 inches, 5.0 inches, 5.25 inches, 5.5 inches, 5.75 inches, 6.0 inches or any reasonable heights H that are greater than or less than the listed values, or range between any of these values.

The opening 80 may comprise a height of, for example, at least about, or no greater than 0.25 inches, 0.5 inches, 0.75 inches, 1.0 inches, 1.25 inches, 1.5 inches, 1.75 inches, 2.0 inches, 2.25 inches, 2.5 inches, 2.75 inches, 3.0 inches, 3.25 inches, 3.5 inches, 3.75 inches, 4.0 inches, 4.25 inches, 4.5 inches, 4.75 inches, 5.0 inches, 5.25 inches, 5.5 inches, 5.75 inches, 6.0 inches or any reasonable heights that are greater than or less than the listed values, or range between any of these values In some embodiments, the height H of the diverter 88 can be related to a corresponding height of the opening 80. For example, the height H can be about 10%, 20%, 25%, 30%, 33%, 40%, 50%, 60%, 66%, 70% 75%, 80%, 85%, 90%, 95%, 100%, 105%, 110%, 115%, 120%, 125%, 130%, 140%, 150%, 160%, 170%, 175%, 180%, 190% or 200% of the height of the opening 80, although other percentages are also possible.

The diverter 88 may also be configured to form an angle $\alpha$ between the diverter 88 and roof deck 14, when the vent 70 (e.g., the lower portion 74 of the vent 70) is installed on the roof deck 14. For example, the angle $\alpha$ can be defined as the angle between the diverter 88 and the lower portion 74 of vent 70 as illustrated. In some embodiments, the angle $\alpha$ can be about 90 degrees as illustrated. Other angles $\alpha$ are also possible. For example, the angle $\alpha$ can be about, at least about, or no greater than 30 degrees, about 40 degrees, about 45 degrees, about 50 degrees, about 60 degrees, about 70 degrees, about 80 degrees, about 100 degrees, about 110 degrees, about 120 degrees, about 130 degrees, about 135 degrees, or about 140 degrees, with other angles $\alpha$ also being possible, including any reasonable angle that is greater than or less than the listed values, or range between any of these values. The angle $\alpha$ can be bent either toward the vent 70 (e.g., in an upslope direction) or away from the vent 70 (e.g., in a downslope direction). The angle $\alpha$ can be selected to prevent or reduce the likelihood that wind or other forces can drive water or other debris through the downslope opening in the vent, while still providing sufficient airflow through the vent. The angle between the angled flange 86 and the upper portion of the vent to which it is attached (e.g., upper portion 72) can be configured within similar values and ranges, and for similar reasons, as the angle $\alpha$.

The diverter 88 can be positioned at a distance D from the front opening 80 in the downslope direction. For example, the distance D can be defined as the distance from the distal end of diverter 88 to the distal end of the flange 86 as shown, or the distance from the distal end of diverter 88 to another downslope edge of upper portion 72 and/or lower portion 74 (for embodiments without flange 86). In some instances, the distance D is measured in a direction that is approximately parallel with the plane of the roof deck, although this does not need to be the case in all embodiments. In some embodiments, the distance D is about, at least about, or no greater than 0.25 inches, 0.5 inches, 0.75 inches, 1.0 inches, 1.25 inches, 1.5 inches, 1.75 inches, 2.0 inches, 2.25 inches, 2.5 inches, 2.75 inches, 3.0 inches, 3.25 inches, 3.5 inches, 3.75 inches, 4.0 inches, 4.25 inches, 4.5 inches, 4.75 inches, 5.0 inches, 5.25 inches, 5.5 inches, 5.75 inches, 6.0 inches, including any reasonable distance that is greater than or less than the listed values, or range between any of these values. Thus, other distances D are also possible.

In some embodiments, the distance D can range from approximately 0.5 inches to approximately 4 inches, or from approximately 0.5 inches to approximately 3.5 inches, or from approximately 0.5 inches to approximately 3 inches, or from approximately 1 to approximately 1.75 inches. In some embodiments, the distance D is selected so that the diverter 88 is positioned outside of the angled flange 86. In some embodiments, the distance D is selected so that the diverter 88 is positioned inside of the angled flange 86. In some embodiments, the distance D is approximately zero, such that the diverter 88 is positioned immediately at the opening 80. The distance D can be selected to prevent or reduce the likelihood that wind or other forces can drive water or other debris through the downslope opening in the vent, while still providing sufficient airflow through the vent.

In some embodiments, the distance D is related to the height H of the diverter 88 or the height of the opening 80. For example, in some embodiments, the distance D can be about 50%, 60%, 66%, 70% 75%, 80%, 85%, 90%, 95%, 100%, 105%, 110%, 115%, 120%, 125%, 130%, 140%, 150%, 160%, 170%, 175%, 180%, 190% or 200% the height H of the diverter 88. In some embodiments, the distance D is at least as great as the height H of the diverter 88. This may provide that the diverter 88 does not restrict the net free vent area (NFVA) of the vent. In some embodiments, the distance D is related to the height of the opening 80. For example, in some embodiments, the distance D can be about 50%, 60%, 66%, 70% 75%, 80%, 85%, 90%, 95%, 100%, 105%, 110%, 115%, 120%, 125%, 130%, 140%, 150%, 160%, 170%, 175%, 180%, 190% or 200% the height of the opening 80.

In the illustrated embodiment, the diverter 88 is illustrated having a generally rectangular shape, although other shapes for the diverter 88 are also possible. In general, the lower edge of the diverter 88 should be configured to follow the surface of the roof and/or the surrounding roof cover elements. The upper edge of the diverter 88 can comprise a straight profile as shown, or other profiles, such as curved, stepped, or angled profiles as desired. Various shapes of the diverter can be selected for functional and/or aesthetic purposes. As mentioned above, for example, FIGS. 9A-9E described further below, show different shapes or profiles for diverters.

Those of ordinary skill in the art will appreciate that varying the size, shape, and position of the diverter 88 may change the ability of the diverter 88 to prevent or reduce the likelihood that water or other debris can be driven by wind or other forces through the opening 80 of the vent. At the same time, that varying size, shape, and position of the diverter 88 may also change airflow characteristics through the vent. Accordingly, certain dimensions, positions, and shapes for the diverter 88 can provide an advantageous balance between blocking or restricting water or other debris flow into the vent while maintaining suitable airflow characteristics. Certain dimensions, positions, and shapes for the diverter 88 can alternatively provide an aesthetic benefit.

In some embodiments, the dimensions of the height H of the diverter 88, the height of the opening 80, and the distance D at which the diverter 88 is positioned in front of the opening can be determined or selected so as to improve or optimize the performance of the vent. For example, these dimensions can be selected to increase (e.g., maximize) airflow and ventilation through the vent while decreasing (e.g., minimizing) the likelihood that water or other debris can be driven by wind or other forces through the opening of the vent. Balancing these dimensions, and the interrelationship between can be challenging. In some embodiments, this optimization or improvement can be achieved by determining or selecting these dimensions such that the diverter 88 has a lower height (e.g., the lowest possible height) in relation to the height of the opening of the vent for various reasons, such as manufacturing ease, conservation of materials, reduced propensity to accumulate debris (which can collect behind the diverter), all while providing the desired weatherability improvements that prevent entry of the elements and increasing the function of the vent by disturbing the air flow over the vent in a wind event, thus, increasing the amount of negative pressure over the vent, creating an air vacuum and drawing air out of the attic area underneath the vent placement through the vent. Thus, it may be desirable to minimize the diverter height relative to the opening, while still providing a diverter with a sufficient height to improve the weatherability of the vent and minimizing the likelihood that water or other debris can be driven by wind or other forces through the opening of the vent.

Additionally, inclusion of the diverter 88 may allow for the size of the opening 80 of the vent to be increased relative to vents that do not include a diverter. Without a diverter, increasing the size of the opening of the vent increases the likelihood that water or other debris can be driven through the opening. Thus, for vents without diverters, the size of the opening is often limited so as to limit debris and water being driven through the vent. Limiting the size of the opening, however, also limits the airflow and ventilation through the vent. However, by including a diverter 88, the size of the opening 80 can be increased because the diverter 88 can prevent debris and water being driven through the vent. Thus, the overall airflow through the vent can be increased. For example, as you increase the height of the diverter, it is possible to increase the height of the opening 88 (and/or increase a corresponding distance D as defined above), in a proportion to the increased height of the diverter. This can be a benefit because as the size of the opening 80 is increased, airflow through the vent is increased. This can create a corresponding increase in the NFVA of the vent. Increased NFVA has clear benefits, however, without the optimum diverter utility increasing the size of the opening increases the potential for failure (i.e., entry of water, snow, flames and embers, and debris) exponentially.

In one example, a tapered composition vent without a diverter (as shown, for example, in FIGS. 2A and 2B) can have a NFVA of about 72 square inches. By including a diverter (as shown, for example, in FIGS. 3A and 3B), the size of the opening 80 can be increased allowing for an increase in the NFVA. For example, in some embodiments, the NFVA can be increased by about 10%, 15%, 25%, 30%, 33%, 40%, 50%, 60%, 66%, 70%, 75%, 80%, 90%, 100%, 125%, 150%, 175%, 200%, 225%, 250%, 275%, 300%, 325%, 350%, 375%, 400%, 425%, 450%, 475%, or 500%, relative to the same vent without a diverter.

FIG. 4A is a table presenting wind and wind-driven rain testing results for roof vents as shown in FIGS. 3A and 3B with several different diverter embodiments. As shown in FIG. 4A, six different diverter embodiments were tested: (1) a 0.5 inch tall diverter angled at 90 degrees; (2) a 0.5 inch tall diverter angled at 45 degrees; (3) a 1.0 inch tall diverter angled at 90 degrees; (4) a 1.0 inch tall diverter angled at 45 degrees; (5) a 1.5 inch tall diverter angled at 90 degrees; and (6) a 1.5 inch tall diverter angled at 45 degrees. For each embodiment, the vent including the diverter was installed on a test roof according to the Testing Application Standard (TAS) No. 100-95, Test Procedure for Wind and Wind Driven Rain Resistance of Discontinuous Roof Systems (TAS No. 100-95). The TAS No 100-95 test is described at http://www2.iccsafe.org/states/Florida2001/FL_TestProtocols/PDFs/Teseting%20Application%20Standard%20No%20100-95.pdf, which is incorporated herein by reference.

As shown in FIG. 4A, with the exception of the first embodiment (a 0.5 inch tall diverter angled at 90 degrees), each embodiment was tested by first applying 70 mph wind and water spray to the roof for fifteen minutes, and then removing the wind and water spray for five minutes to allow any accumulated water to drain through the vent. Water that infiltrated through the vent was collected and measured to determine how successful the diverter was at preventing water from being driven into the vent. For the first embodiment, the wind and water spray procedure was stopped after only three minutes because the asphalt shingles on the test roof began to uplift; however, significant water infiltration through the vent was recorded, despite the shortened test procedure.

As shown in the Result column of the table in FIG. 4A, each embodiment experienced some water infiltration during the wind and water spray portion of the test. However, when the water was collected and measured after five minutes with no wind and water, it became apparent that certain diverter embodiments outperformed others in terms of preventing water from infiltrating through the vent. For example, the first and second embodiments (with the 0.5 inch diverters) exhibited substantial water infiltration. The second and third embodiments (with the 1.0 inch diverters) performed better, but still allowed some water infiltration. The 1.0 inch diverter angled at 90 degrees allowed 60 mL of water infiltration, while the 1.0 inch diverter angled at 45 degrees allowed 260 mL of water infiltration. The fifth and sixth embodiments (with the 1.5 inch diverters) performed best. The 1.5 inch diverter angled at 90 degrees allowed 6 mL of water infiltration, and the 1.5 inch diverter angled at 45 degrees allowed only 1 mL of water infiltration.

From these tests, it can readily be seen that diverters of at least 1 inch advantageously provide improved resistance to water infiltration when compared to shorter (e.g., less than 1 inch) diverters.

FIG. 4B is a table presenting wind and wind-driven rain testing results for a roof vent as shown in FIGS. 3A and 3B with an embodiment of diverter that is 1.5 inches tall and angled at 45 degrees in a downslope direction. The sixth embodiment tested as described above (1.5 inches diverter angled at 45 degrees) performed the best of the embodiments tested. As such, this embodiment, was subjected to the full battery of TAS No. 100-95 tests. The results are summarized in the table shown in FIG. 4B. As shown, this embodiment performed well at all wind speeds between 0 and 110 mph.

Thus, embodiments of the vents herein can include diverters configured that water infiltration through the vent is reduced, while providing sufficient ventilation. For example, when tested according to TAS No. 100-95, water infiltration can be 300 ml or less, 275 ml or less (including 260 ml or less), 250 ml or less, 225 ml or less, 200 ml or less, 175 ml or less, 150 ml or less, 125 ml or less, 100 ml or less, 75 ml or less (including 60 ml or less), 50 ml or less, 40 ml or less, 30 ml or less, 25 ml or less, 20 ml or less, 15 ml or less, 10 ml or less, 5 ml or less, 4 ml or less, 3 ml or less, 2 ml or less, 1 ml or less, or no substantially recordable water infiltration.

The aforementioned and other dimensional aspects of the embodiments of the vents and diverters described herein can provide reduced leaking, with improved ventilation, for various types of ventilation systems provided in various implementations. In some embodiments, the dimensional aspects can provide particular advantages within the context of vents sized and configured for installation without requiring additional blocking or structural support. For example, many building codes and standard building practices require additional blocking and structural support (e.g., within the standard rafter spacing of a roof) whenever an opening is formed in the roof deck that is larger than 144 square inches. Thus, the vents described herein can be configured to be installed over or in roof deck openings that are less than 144 square inches so as to not require additional blocking or structural support. This may advantageously facilitate installation of the vents. In other embodiments, the vents described herein can be configured for installation over or in roof deck openings that are larger than 144 square inches.

Figure 5C:
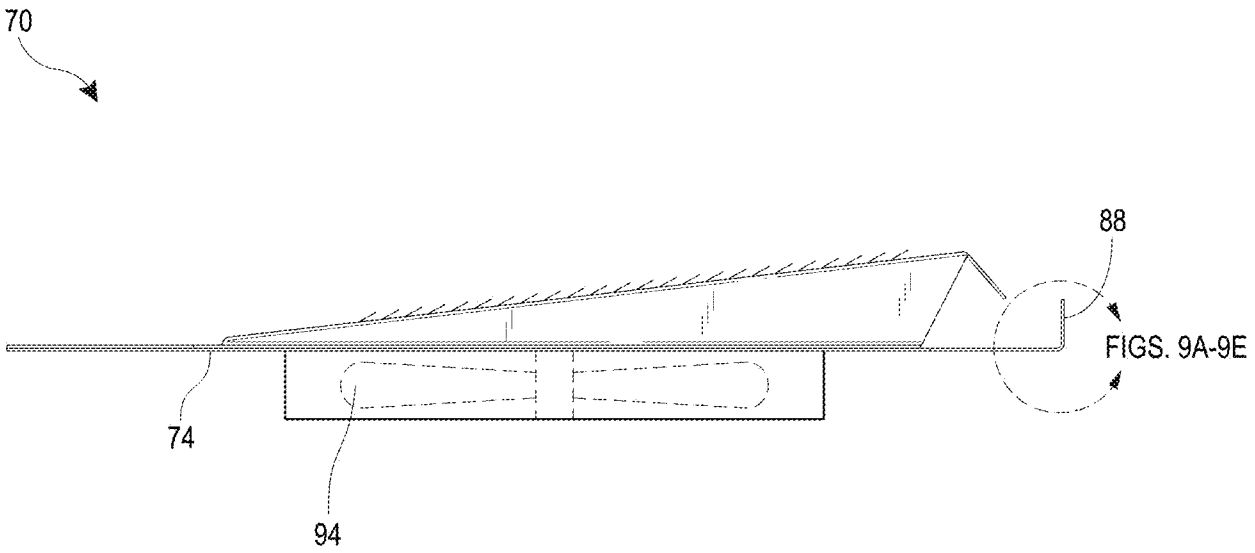
FIG. 5C illustrates a side view of an embodiment of the roof vent of FIG. 3A includes an embodiment of a fan.

As mentioned above, the roof vent 70 of FIGS. 3A and 3B may be referred to as a tapered roof vent or tapered composition roof vent because of its generally tapered or nozzle-like shape. FIGS. 5A-5C illustrate embodiments of the roof vent 70 that include one or more additional features.

For example, FIG. 5A illustrates an isometric view of an embodiment of the roof vent 70 that includes a non-continuous diverter 88, e.g., with cutouts 89. The cutouts 89 may form spaces along the diverter 88, such that the diverter 88 extends non-continuously, i.e., intermittently, across the width of the vent 70. As noted above, the cutouts 89 can provide aesthetic benefits and/or can provide access into the gap formed between the diverter 88 and the remainder of the vent 70. The cutouts can, for example, provide access for debris removal or to facilitate manufacturing of the vent 70 (e.g., to allow tool access). For example, in some embodiments, vents 70 can be manufactured in part using a clinching machine. Gaps in the diverter 88 can be configured and positioned so as to allow the clinching machines to gain access to the clinch points. In some embodiments, this can prevent or reduce the likelihood of tool lockout during manufacturing.

In the illustrated embodiment, the vent 70 includes three cutouts 89 that divide the diverter 88 into four portions. Other numbers of cutouts 89, dividing the diverter 88 into other numbers of portions are also possible. In some embodiments, the cutouts 89 are evenly spaced along the diverter 88. In some embodiments, the cutouts 89 are not evenly spaced. In some embodiments, the locations of the cutouts 89 are selected so as to allow appropriate tool access during manufacturing as mentioned above.

FIG. 5B illustrates an isometric view of an embodiment of the roof vent 70 that includes an embodiment of a solar panel 92. In the illustrated embodiment, the solar panel 92 is positioned on the upper portion 72 of the vent 70 between the louvers 84. Other positions for the solar panel 92 are possible. As illustrated, the solar panel 92 is generally flat and rectangular or square, although other shapes of the solar panel 92 are also possible. The solar panel 92 may be configured to collect solar energy in order to generate electricity. In some embodiments, the electricity generated by the solar panel 92 is used to power certain components of the vent 70. For example, the electricity generated by the solar panel 92 can be used to power a fan 94 that can be included in some embodiments of the vent 70, as shown in FIG. 5C. In other embodiments, the electricity generated by the solar panel 92 can be used to power the home or other structure on which the vent 70 is installed or supplied back to the power grid.

FIG. 5C illustrates a side view of an embodiment of the roof vent 70 that includes an embodiment of a fan 94. The fan 94 can be configured to provide active ventilation through the vent 70. In some embodiments, the fan 94 is attached directly to the lower portion 74 of the vent 70. In some embodiments the fan 94 is provided as a separate component or assembly that may or may not be attached directly to the remainder of vent 70. For example, in some embodiments, the vent 70 comprises a primary (e.g., lower) vent member that includes a fan assembly and can be configured to be mounted to the roof deck (to allow flow through an opening through the roof deck), and a secondary (e.g., upper) roof vent member that can be configured to be mounted in or on a field of roof cover elements. The primary and secondary roof vent members can be directly attached to each other (e.g., as shown in FIG. 5C), or can be spaced from each other without being directly attached to each other. In some embodiments, the primary and secondary roof vent members can be laterally spaced from each other. For example, with the primary vent member attached upslope or downslope on a roof, relative to the secondary roof vent member. The fan 94 can be provided with a flange that can be attached to the roof deck and the vent 70 can be installed over the fan 94. In some embodiments, the fan 94 is powered with a solar panel included on the vent (e.g., solar panel 92 of FIG. 3B), although this need not be the case in all embodiments. Examples of primary and secondary roof vent members are described in U.S. Patent Application Publication No. 2015/0253021, the entirety of which is hereby incorporated by reference.

The diverter 88 of the vent 70 can include various profiles or shapes as illustrated, for example, in FIGS. 9A-9E discussed further below.

The diverter and many of the other features and functionality described with reference to FIGS. 2A-3B and FIGS. 5A-5C, and the results from the testing described with reference to FIGS. 4A and 4B, can be similarly applied to other types of roof vents and ventilation systems. While FIGS. 2A-3B and FIGS. 5A-5C have generally provided examples with respect to a tapered vent, the principles and features described above can also be advantageously implemented on other types of roof vents. For example, FIGS. 6A-6H illustrate embodiments of flat roof vents, FIGS. 7A-7I illustrate embodiments of S-shaped roof vents, and FIGS. 8A-8I illustrated embodiments of M-shaped roof vents that include diverters and other features similar to those described above.

Figure 6A:
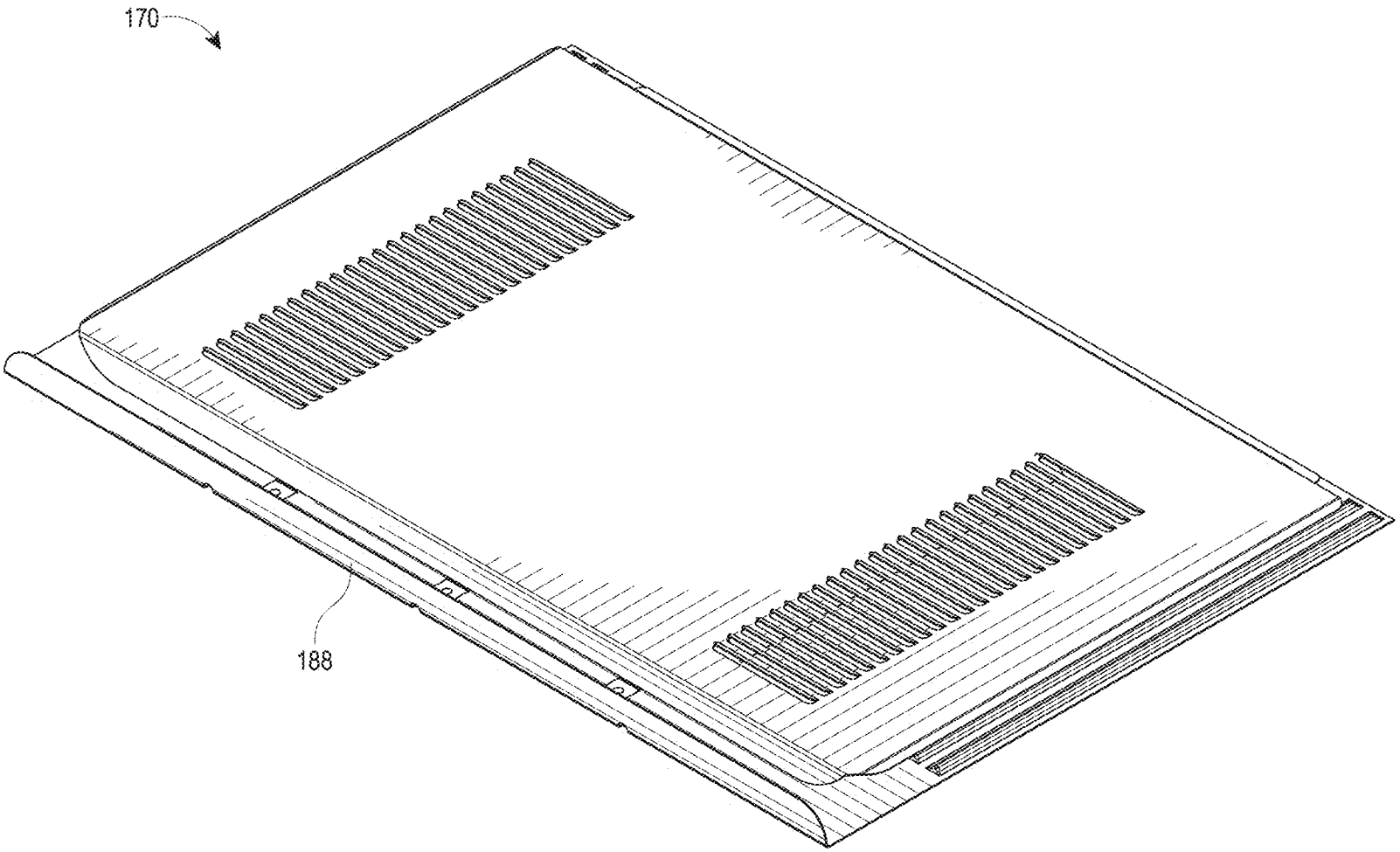
FIGS. 6A-6H illustrate various embodiments of flat roof vents that include diverters.
Figure 6B:
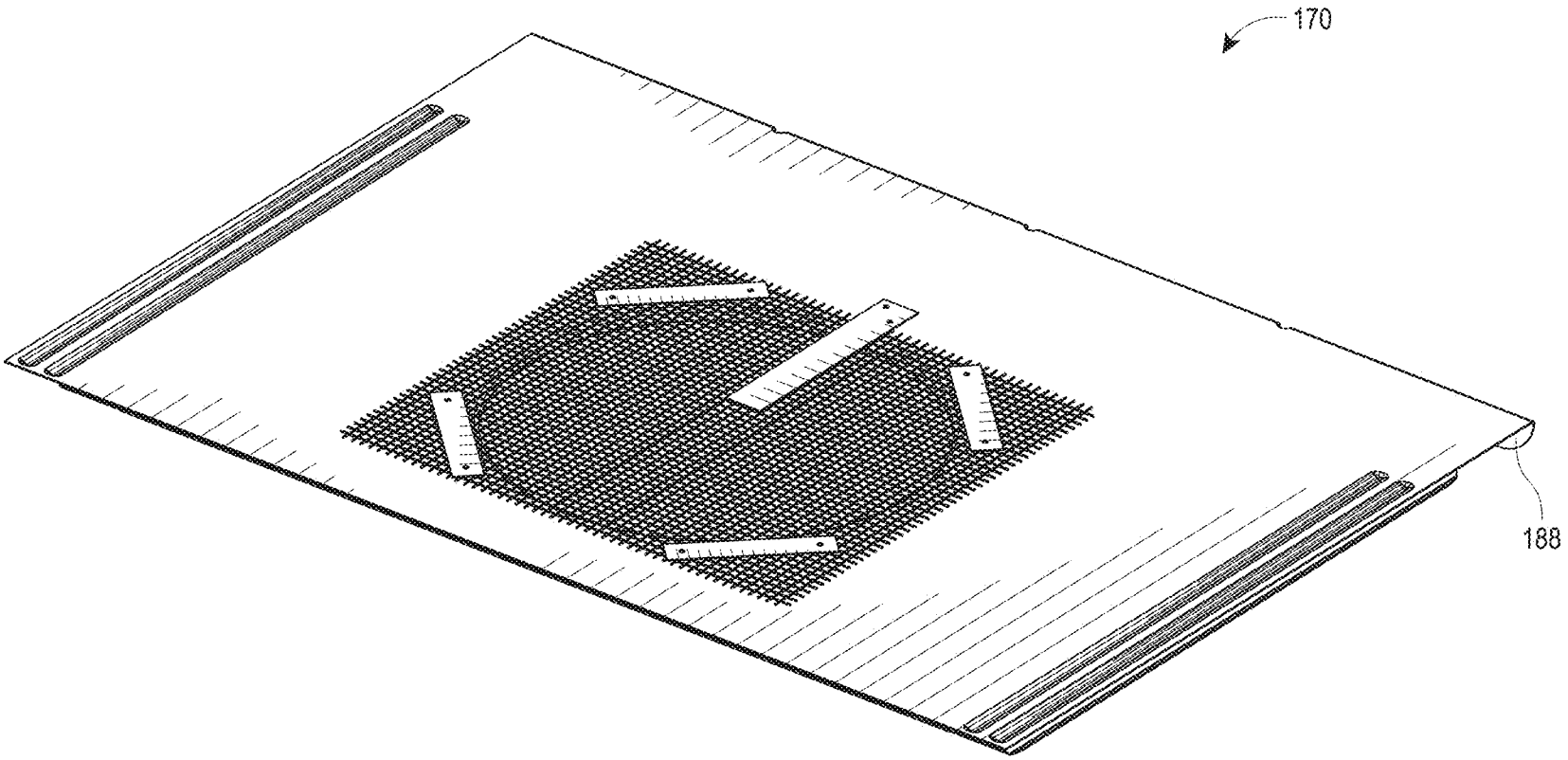
Figure 6C:
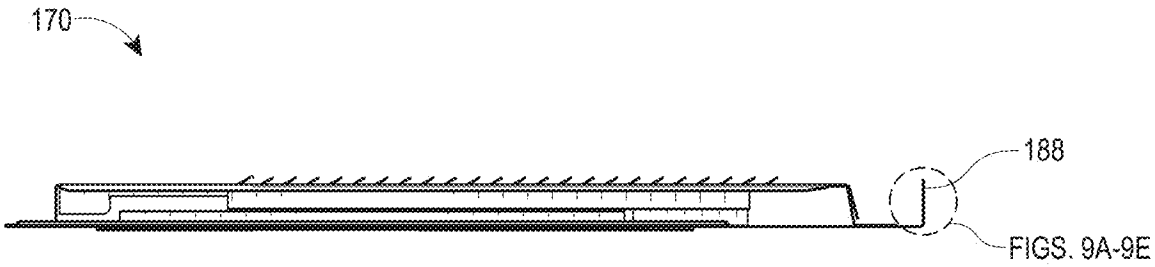

FIGS. 6A-6H illustrate various embodiments of flat roof vents 170 that include diverters 188. FIGS. 6A and 6B are isometric top and bottom views of the flat roof vent 170 having a diverter 188. The diverter 188 can be configured and positioned as described above to prevent or reduce the likelihood that wind or other forces can drive water or other debris through the vent 170. FIG. 6C is a side view of the flat roof vent 170 illustrating an example profile for the diverter 188. The diverter 188 may comprise other profiles or shapes as illustrated, for example, in FIGS. 9A-9E discussed further below.

Figure 6D:
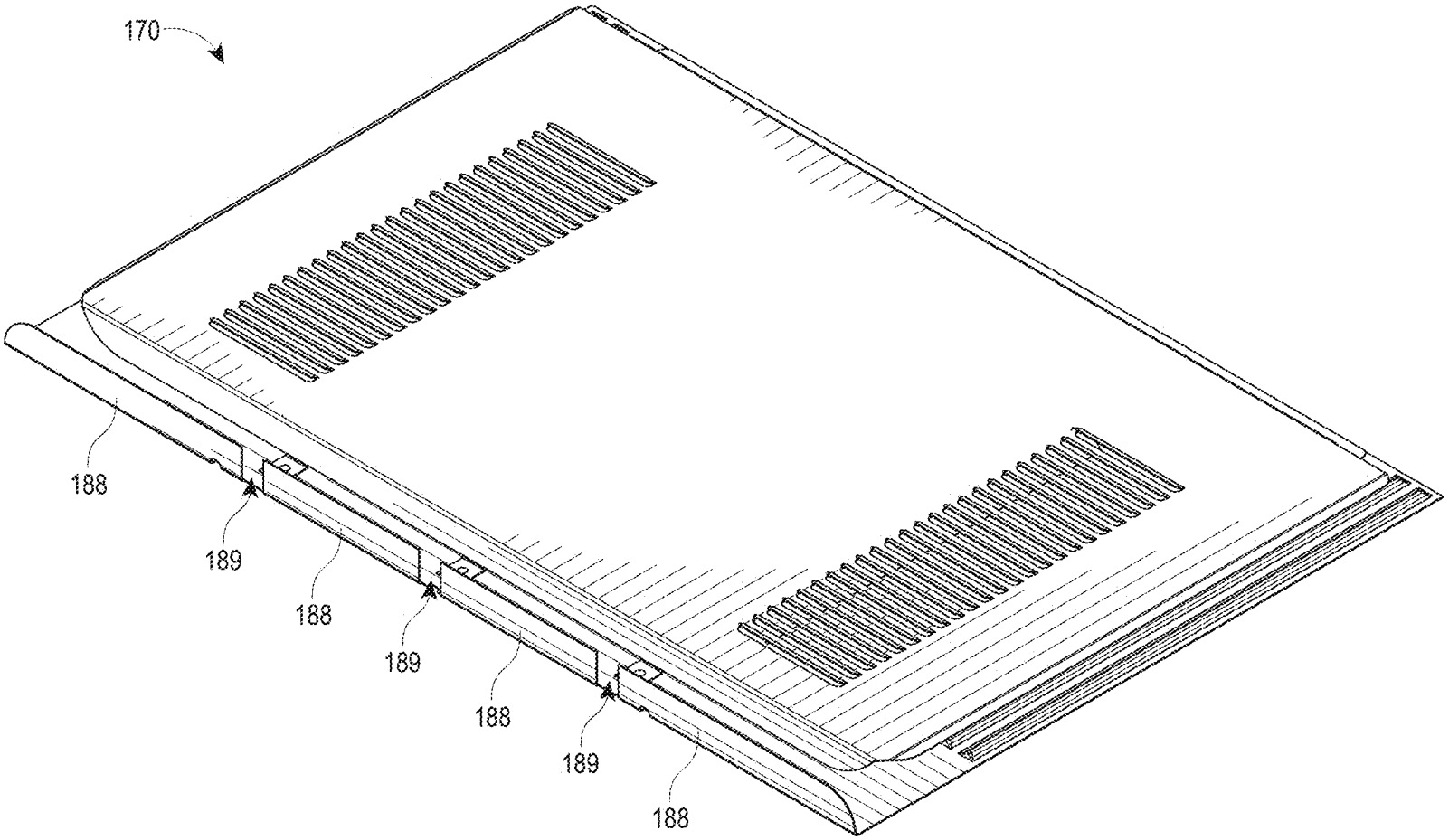

FIG. 6D is an isometric top view of an embodiment of the flat roof vent 170 that includes an embodiment of a non-continuous diverter 188, e.g., with cutouts 189. As described above, the cutouts 189 may divide the diverter 188 into one or more portions. The cutouts 189 may be configured to provide tool access (e.g., to a crimping tool) used during manufacture of the vent and/or provide access for debris removal as described above. Although three cutouts 189 are illustrated, the flat vent 170 may include other numbers of cutouts 189 in other embodiments.

Figure 6E:
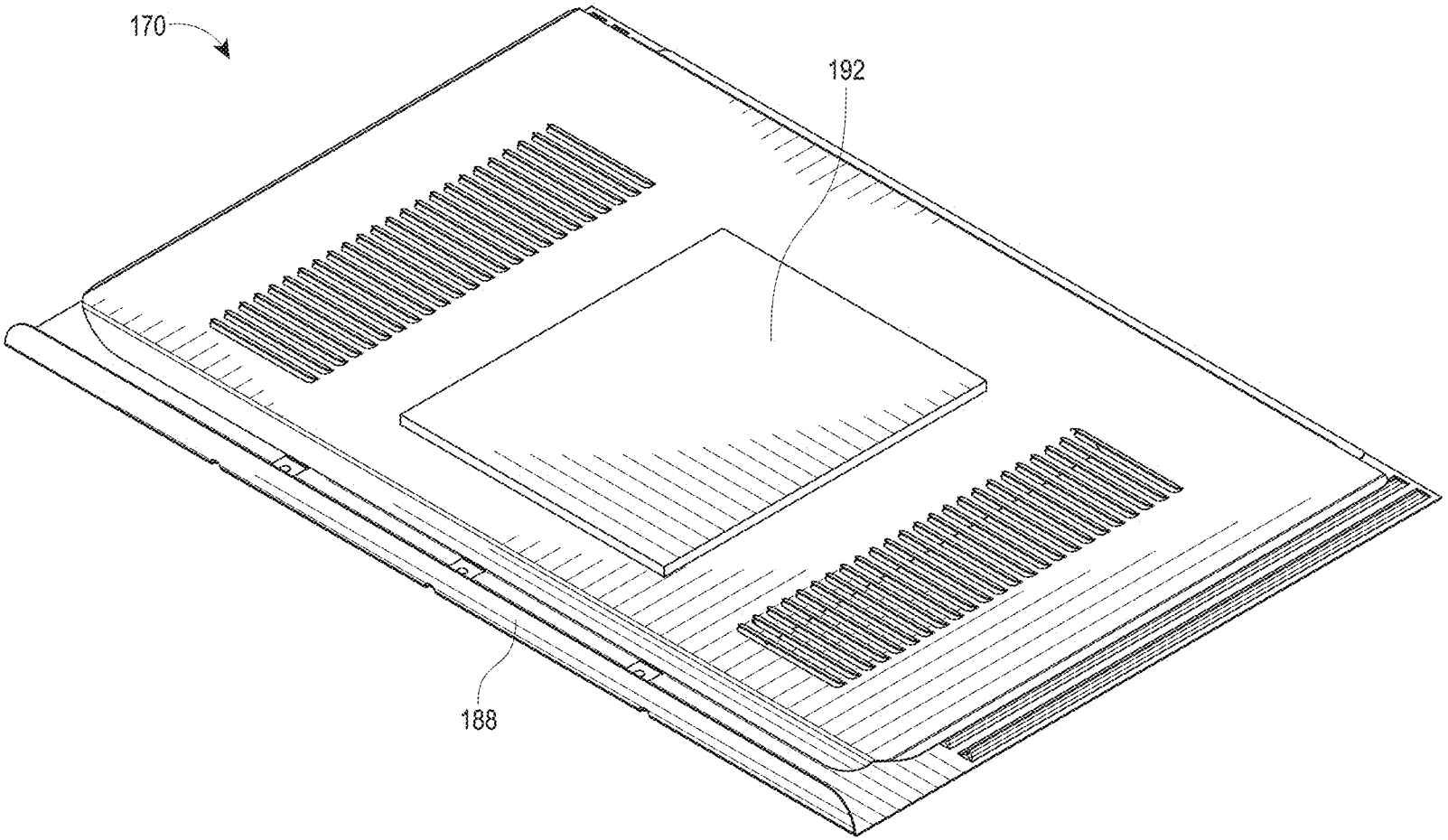

FIG. 6E is an isometric top view of an embodiment of the flat roof vent 170 with the diverter 188 that also includes an embodiment of a solar panel 192. The solar panel 192 may be configured as described above to power components of the vent 170, to provide power for the structure on which the vent 170 is installed, and/or to provide electricity back to the power grid.

Figure 6F:
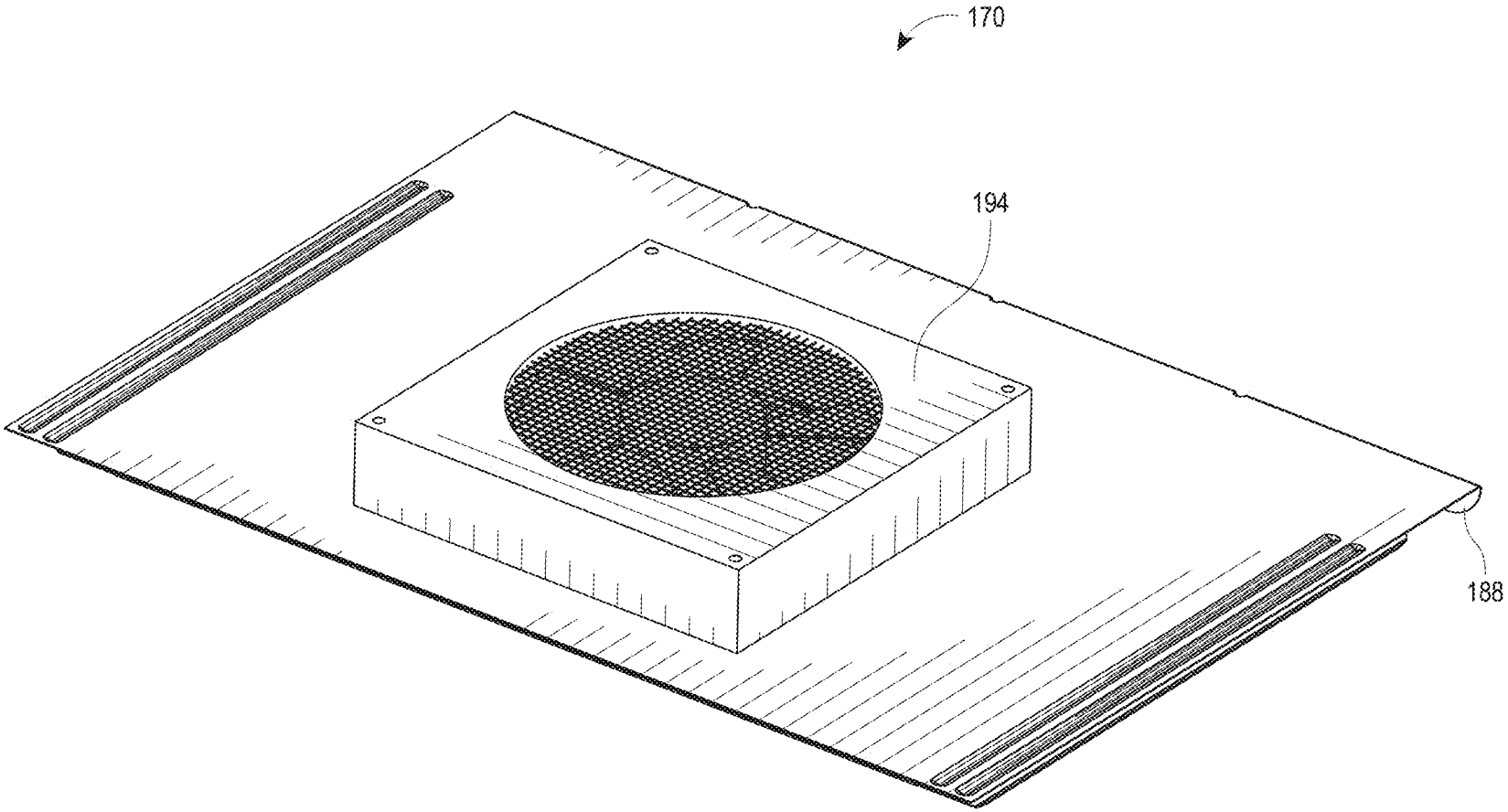
Figure 6G:
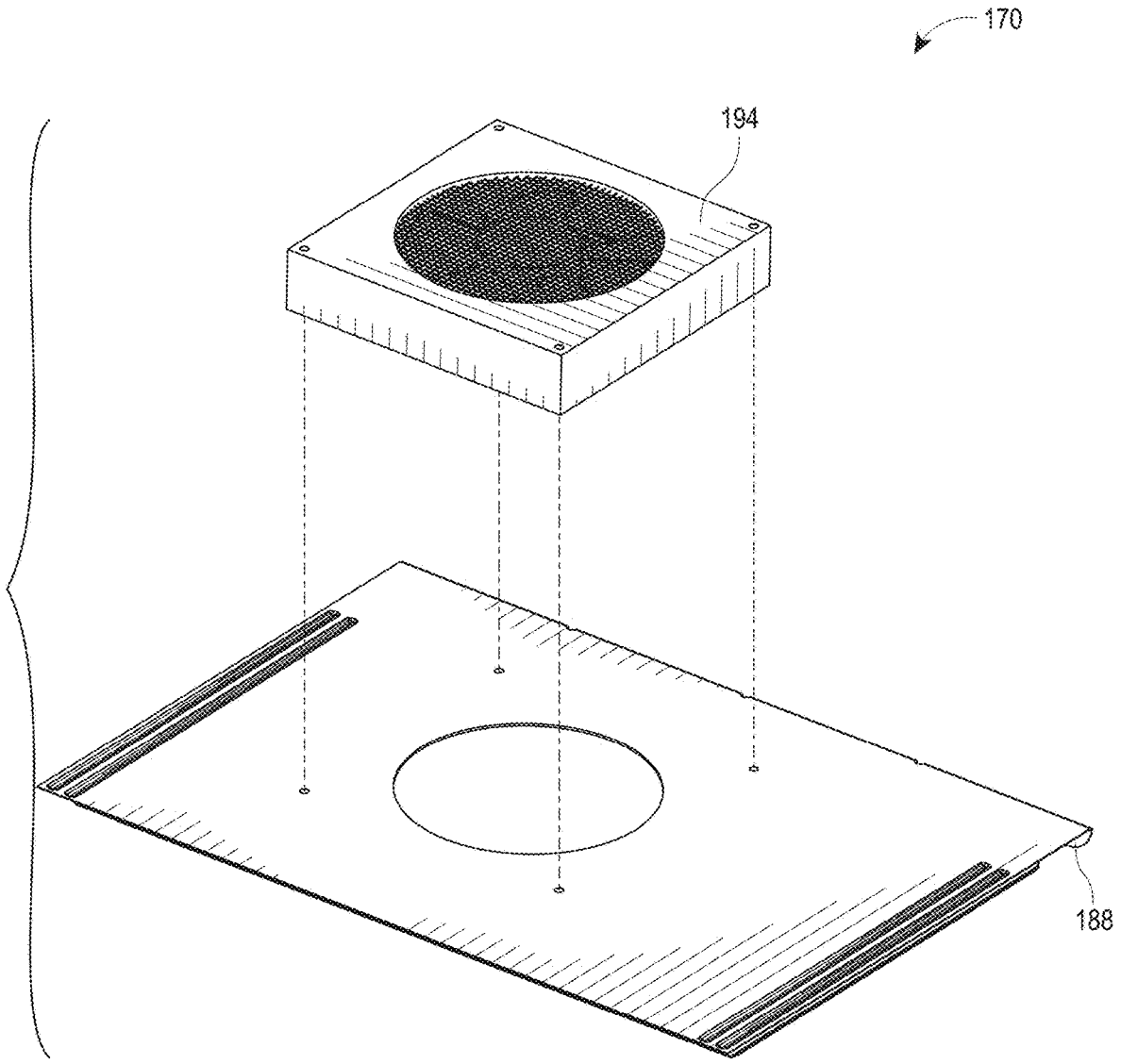

FIG. 6F is an isometric bottom view of an embodiment of the flat roof vent 170 with the diverter 188 that also includes an embodiment of a fan 194. FIG. 6G is an exploded view of the flat roof vent of FIG. 6F. In the illustrated embodiment, the fan 194 is provided in an assembly or housing that can be attached to a lower or bottom surface of the roof vent 170. The fan 194 can be configured to provide active ventilation through the vent 170.

Figure 6H:
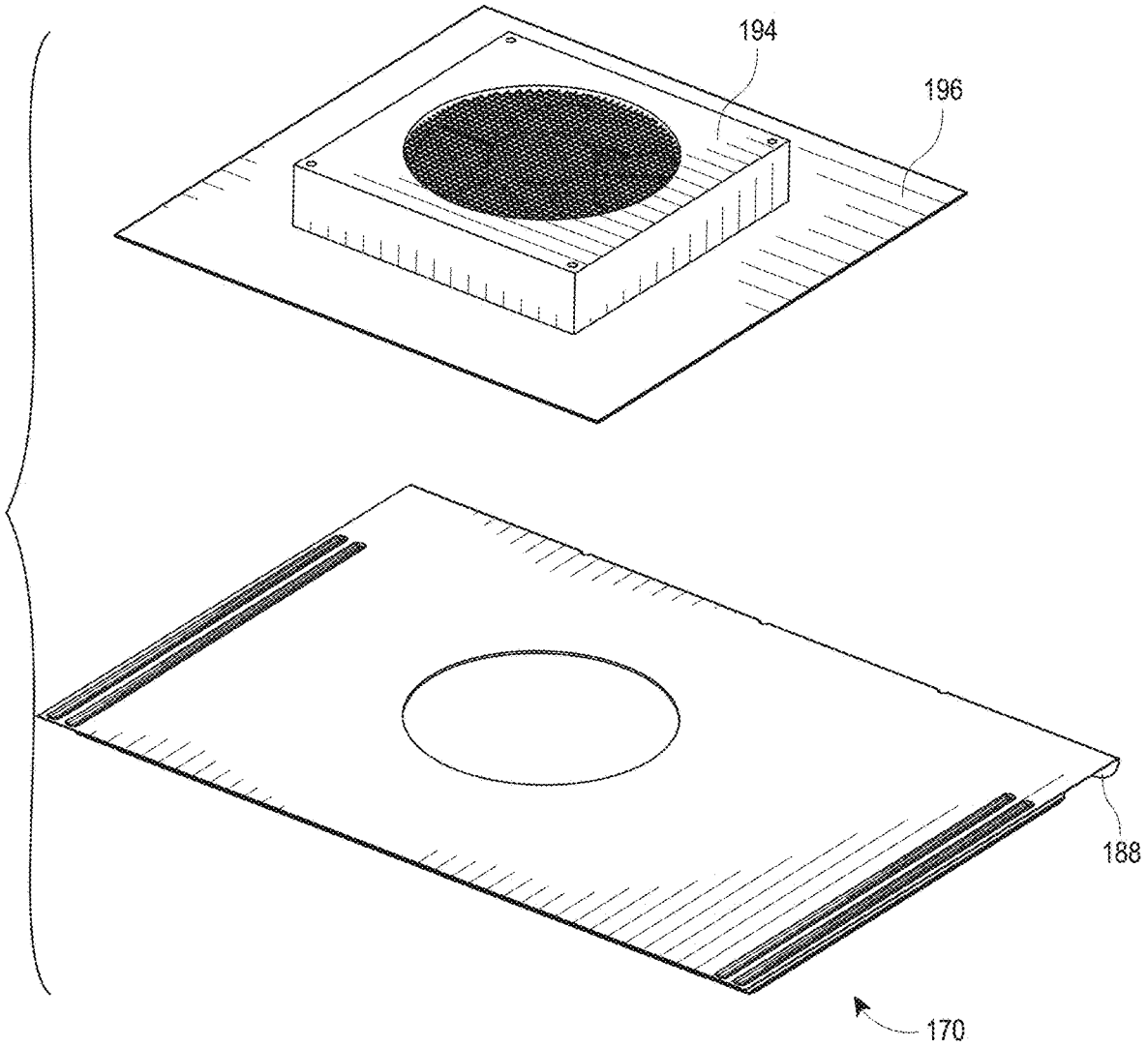

FIG. 6H is an exploded bottom view of an embodiment of the flat roof vent of FIG. 6A that includes another embodiment of the fan 194. In this embodiment, the vent 170 is provided with a primary vent member that includes the fan 194 and a flange 196, and a secondary vent member that includes the upper portion of vent, including the diverter 188. The flange 196 can allow the primary vent member and fan 194 to be mounted to the roof deck. The secondary vent member of the roof vent 170 can then be positioned over the primary vent member (e.g., directly over, or laterally spaced, but over). In some embodiments, the primary vent member is not directly attached to the secondary vent member. For example, in some embodiments, the primary vent member and the secondary vent member can comprise separate components. The fan assemblies described herein can include a lower screen (e.g., as shown in FIGS. 6F-6H), and/or an upper screen (e.g., as shown in FIG. 7E).

In one example, a flat vent without a diverter can have a NFVA of about 98.75 square inches. By including a diverter (as shown, for example, in FIGS. 6A-6H), the size of the opening at the front of the vent can be increased allowing for an increase in the NFVA. For example, in some embodiments, the NFVA can be increased by about 10%, 15%, 25%, 30%, 33%, 40%, 50%, 60%, 66%, 70%, 75%, 80%, 90%, 100%, 125%, 150%, 175%, 200%, 225%, 250%, 275%, 300%, 325%, 350%, 375%, 400%, 425%, 450%, 475%, or 500%, relative to the same vent without a diverter.

Figure 7A:
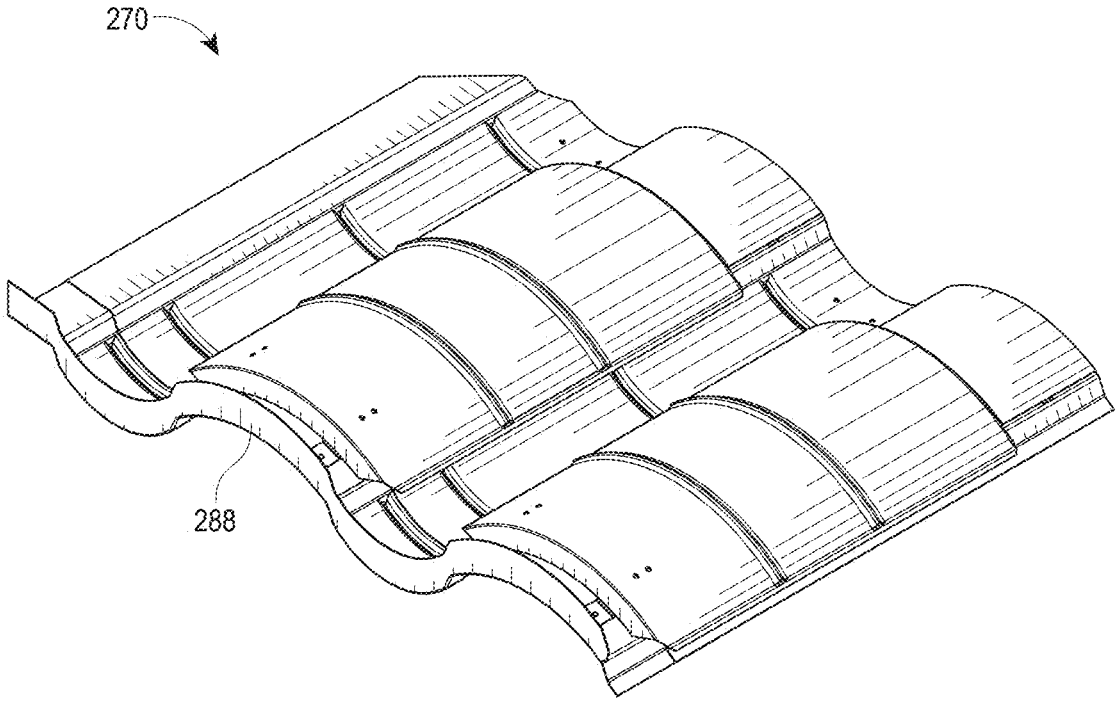
FIGS. 7A-7I illustrate various embodiments of S-shaped roof vents that include diverters.
Figure 7B:
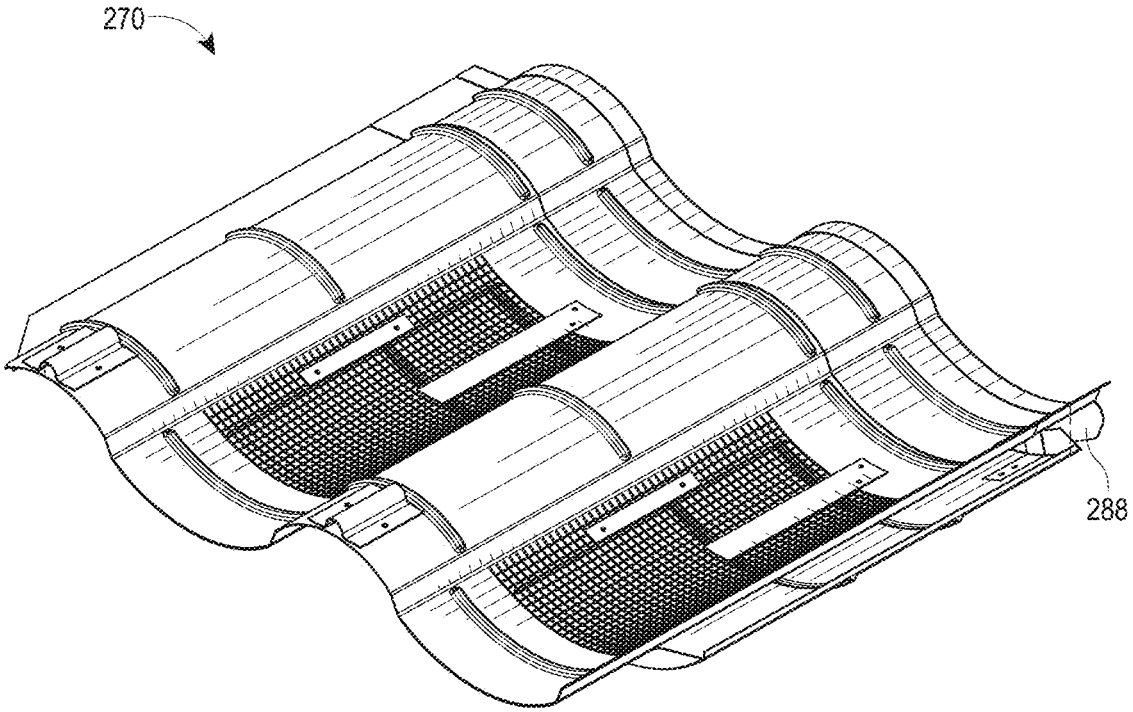
Figure 7C:
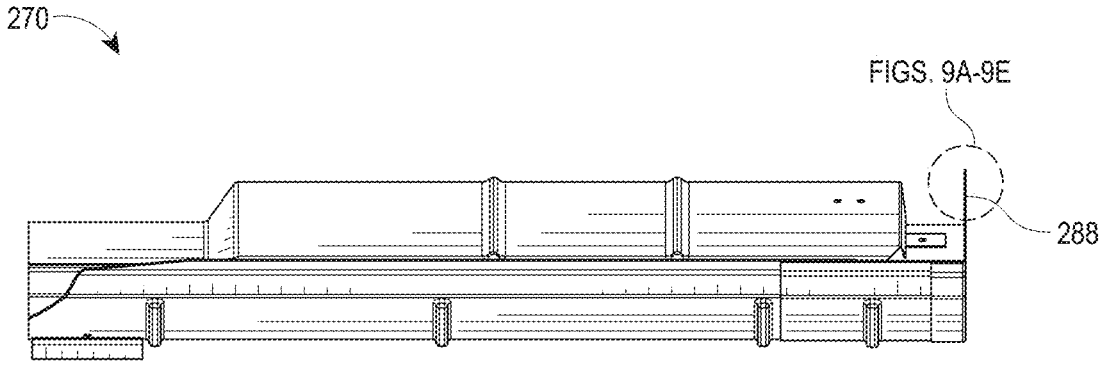
Figure 7D:
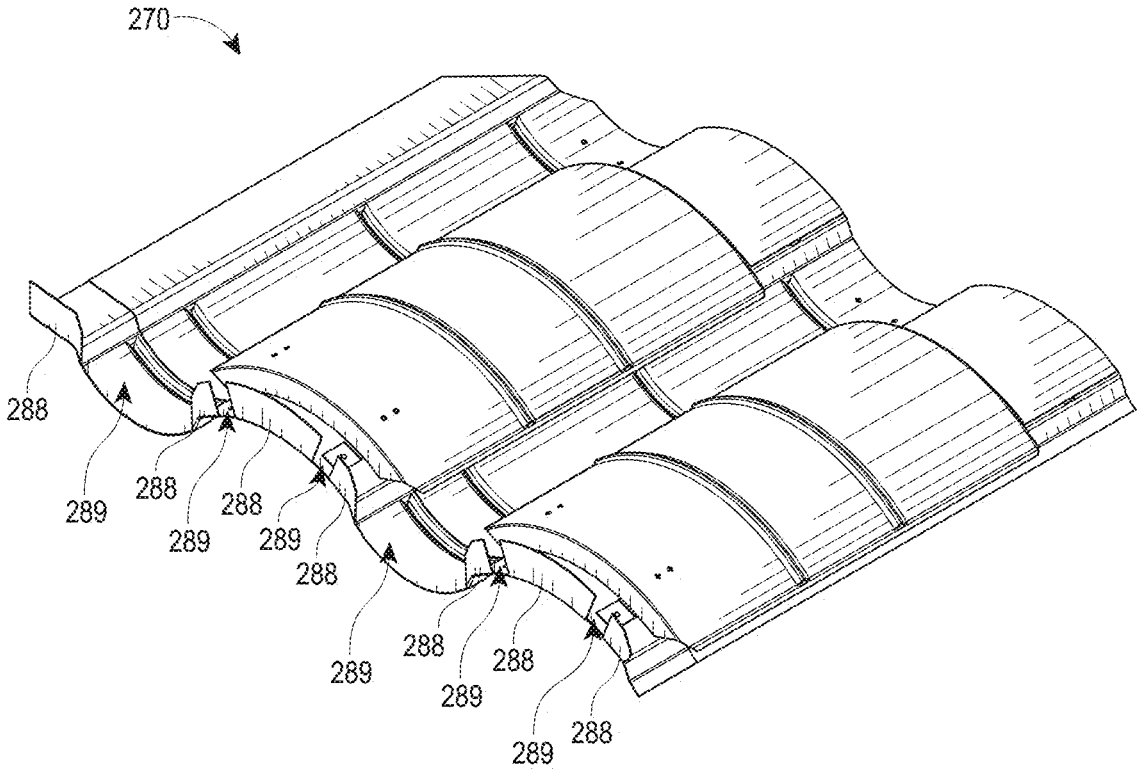
Figure 7E:
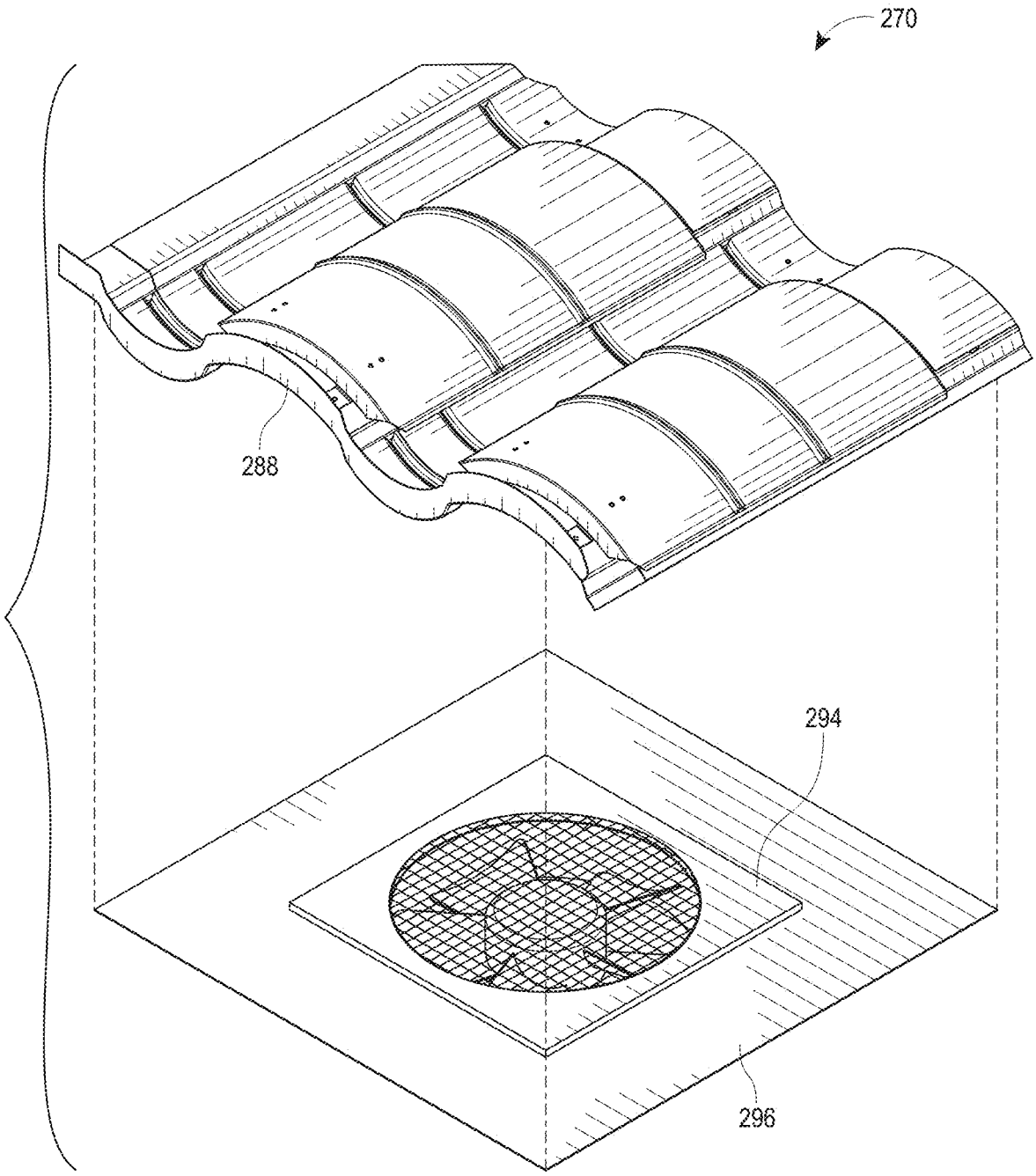

FIGS. 7A-7I illustrate various embodiments of S-shaped roof vents 270 that include diverters 288. In some embodiments, the S-shaped roof vents 270 can be configured to mimic the appearance of S-shaped roof tiles. FIGS. 7A and 7B are isometric top and bottom views of the S-shaped roof vent 270 that includes an embodiment of a diverter 288. The diverter 288 can be configured and positioned as described above to prevent or reduce the likelihood that wind or other forces can drive water or other debris through the vent 270. FIG. 7C is a side view of the S-shaped roof vent 270 illustrating an example profile for the diverter 288. The diverter 288 may comprise other profiles or shapes as illustrated, for example, in FIGS. 9A-9E discussed further below.

FIG. 7D is an isometric top view of an embodiment of the S-shaped roof vent 270 that includes an embodiment of a non-continuous diverter 288, e.g., with cutouts 289. As described above, the cutouts 289 may divide the diverter 288 into one or more portions. The cutouts 289 may be configured to provide tool access (e.g., to a crimping tool) used during manufacture of the vent and/or provide access for debris removal as described above. Although four cutouts 289 are illustrated, the S-shaped roof vent 270 may include other numbers of cutouts 289 in other embodiments. Further, in the illustrated embodiment, the S-shaped roof vent 270 includes cutouts 289 in the troughs formed between the peaks of the S-shaped vent 280. Stated another way, in some embodiments, the diverter 289 may be formed only on the peak areas of the S-shaped roof vent 270.

Figure 7F:
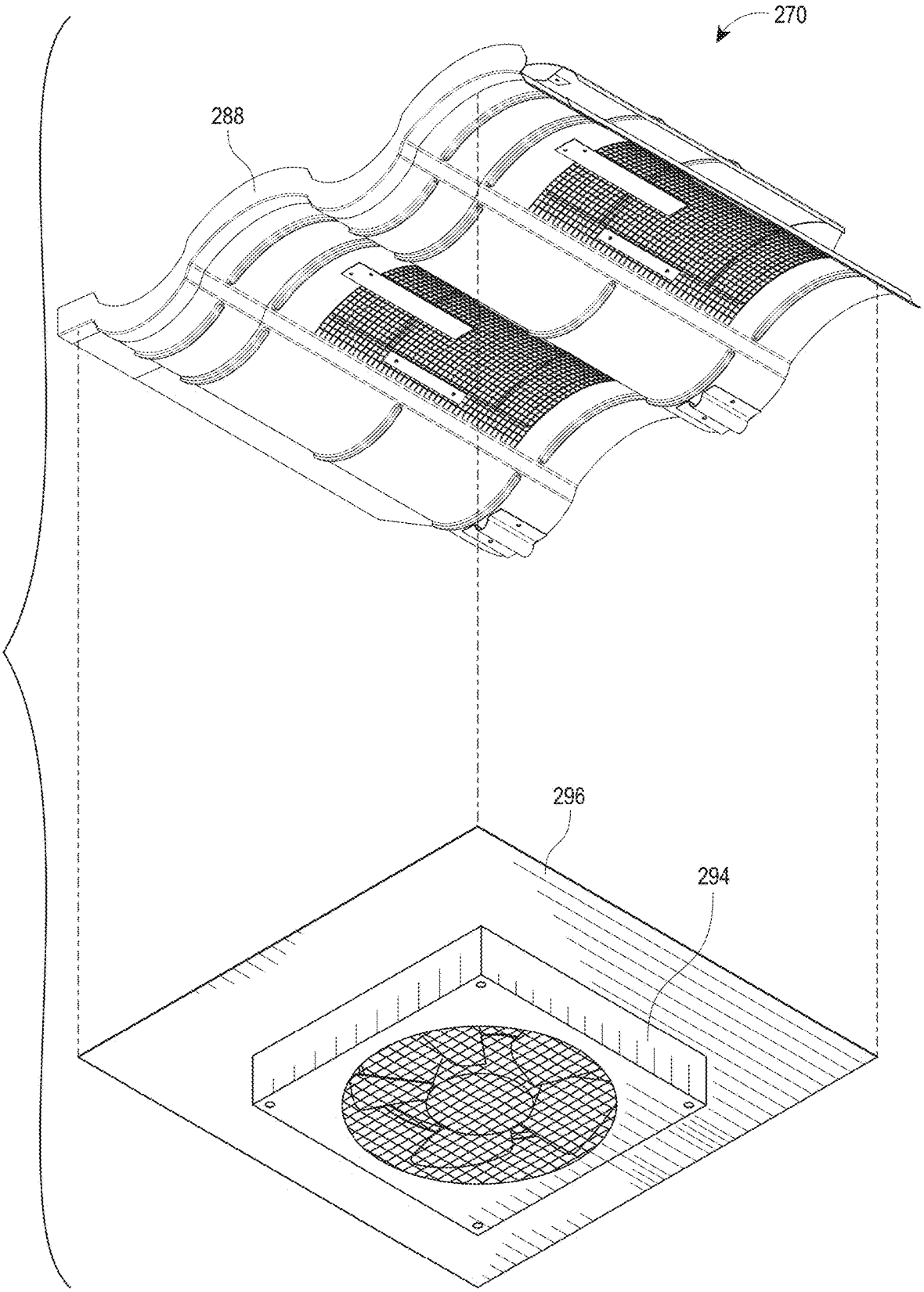

FIGS. 7E and 7F are top and bottom exploded views of an embodiment of the S-shaped roof vent 270 that includes an embodiment of a fan 296. As before, the fan 296 may be configured to provide active ventilation through the S-shaped roof vent 270. In the illustrated embodiment, the fan 294 is provided with a flange 296 on a primary vent member. The flange 296 can allow the fan 294 to be mounted to the roof deck. The secondary vent member of the vent 270 (i.e., the S-shaped portion) can then be positioned over the fan 294. In some embodiments, the vent 270 and the fan 294 comprise separate components. In some embodiments, the fan 294 can be attached to the vent 270.

Figure 7G:
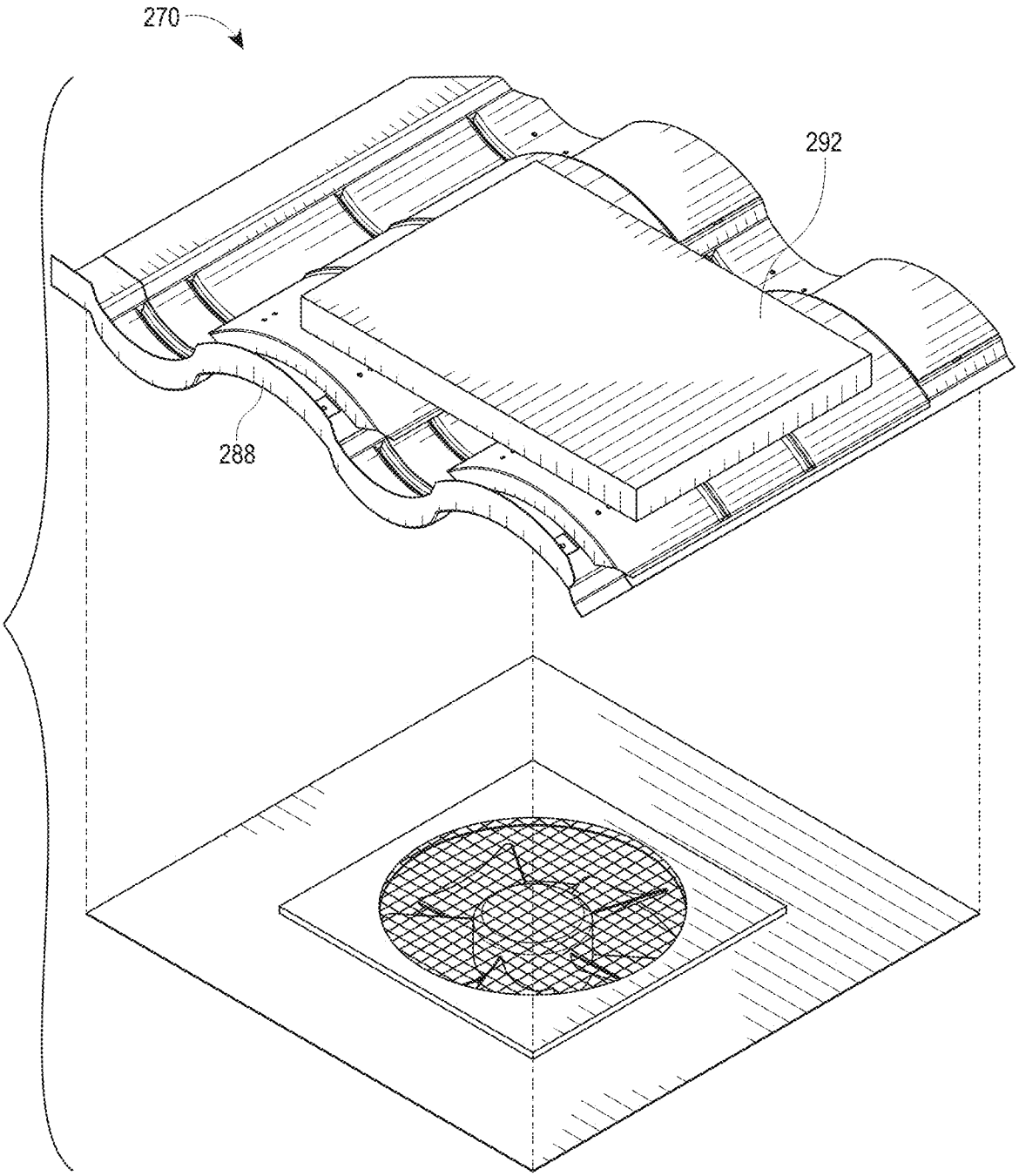
Figure 7H:
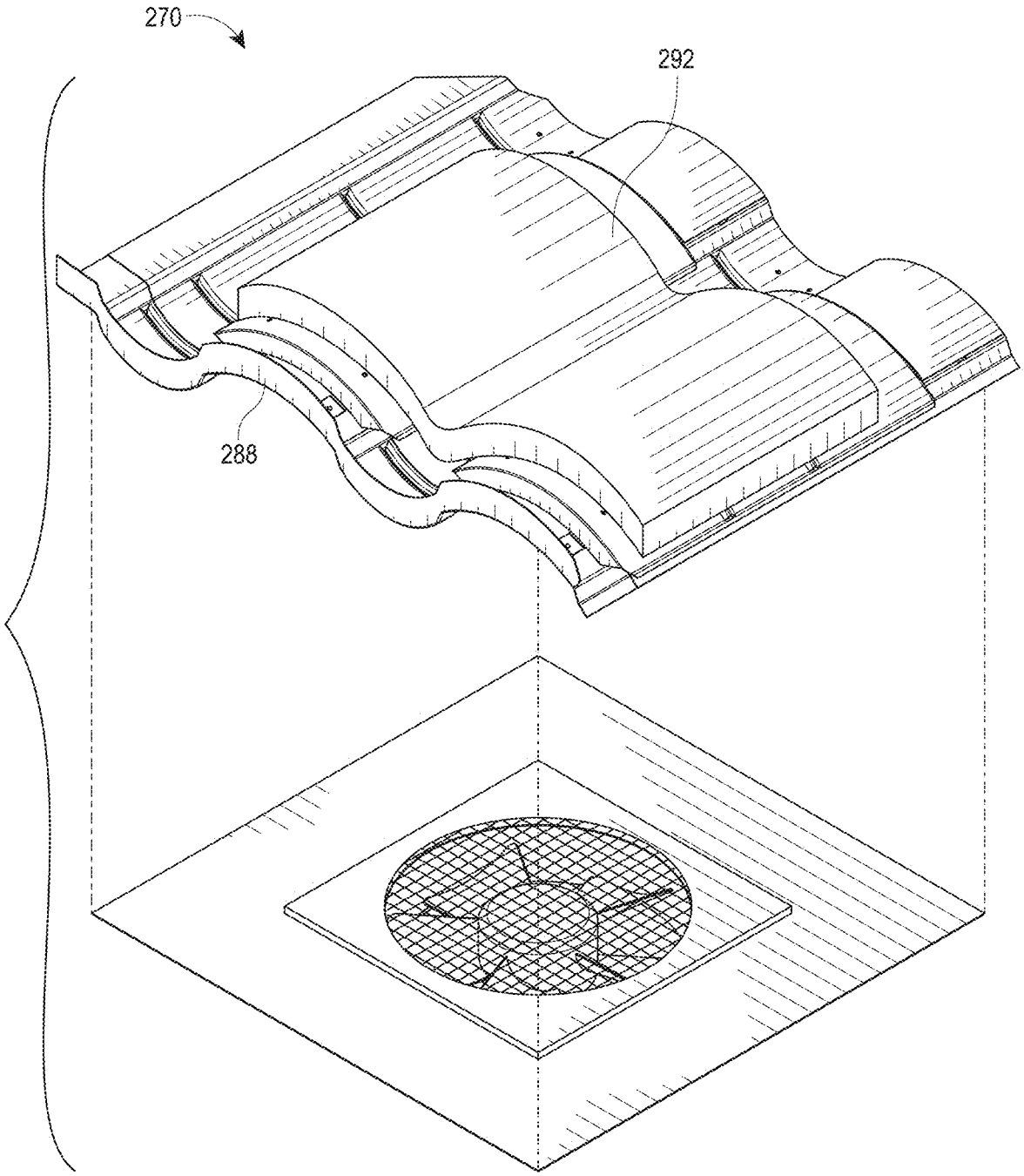
Figure 7I:
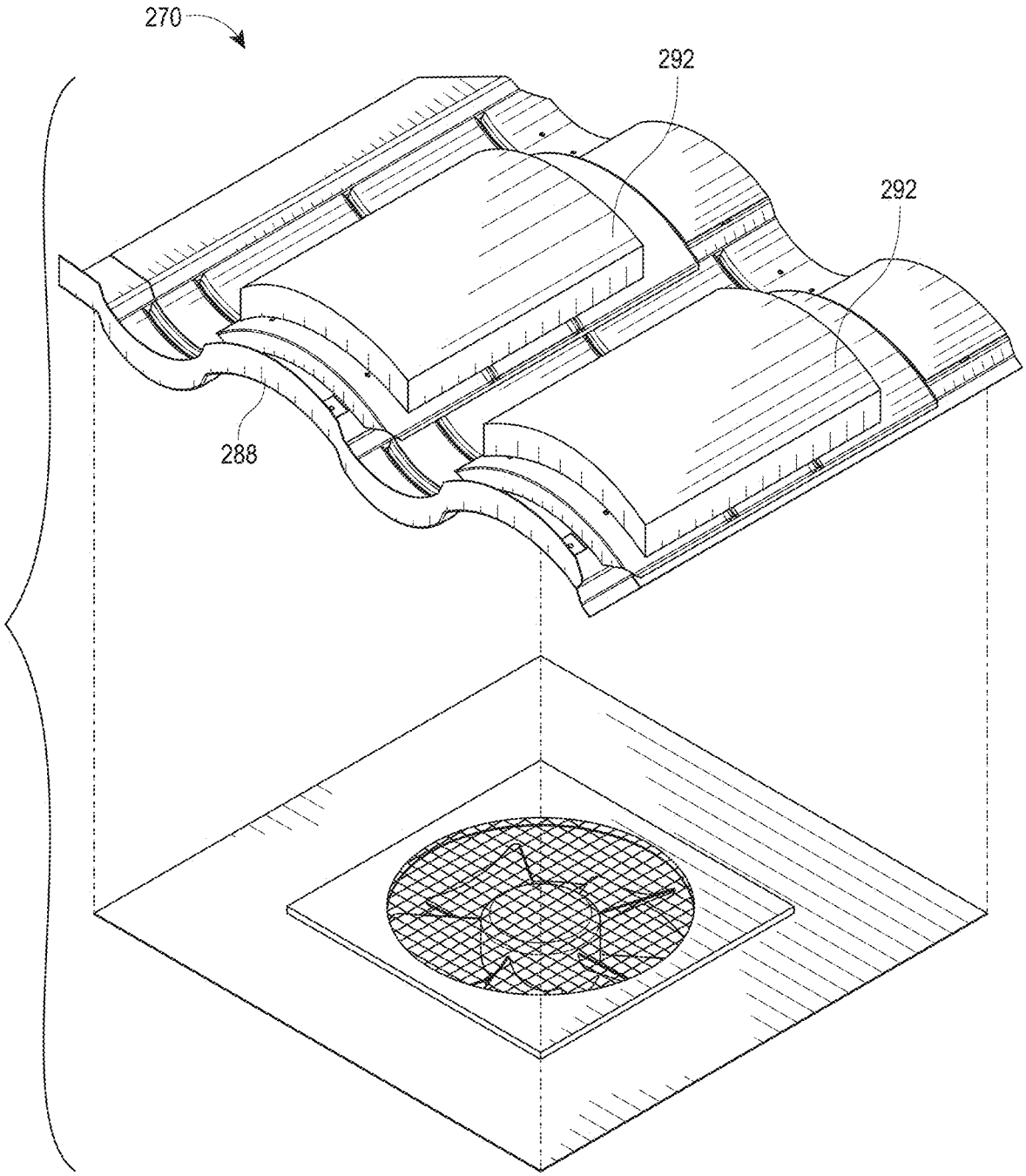

FIGS. 7G, 7H, and 7I are top exploded views of an embodiment of the S-shaped roof vent 270 with a diverter 280 that illustrate various embodiments of solar panels 292 that can be included thereon. Although FIGS. 7G-7I also illustrate the fan, it will be appreciated that the fan can be implemented with or without a solar panel in some embodiments, and vice versa. Similarly, other embodiments of the vents herein that show both a fan and solar panel should not be limited as such, nor should any vent herein require either. The solar panels 292 can be configured to power certain components of the vent 270 (e.g., the fan 294) to provide power for the structure on which the vent 270 is installed, and/or to provide electricity back to the power grid as mentioned above. FIG. 7G illustrates an embodiment of the vent 270 that includes a flat solar panel 292. FIG. 7H illustrates an embodiment of the vent 270 that includes a curved solar panel 292. FIG. 7I illustrates an embodiment of the vent 270 that includes two curved solar panels 292 positioned over the peaks of the vent 270.

In one example, an S-vent without a diverter can have a NFVA of about 97.5 square inches. By including a diverter (as shown, for example, in FIGS. 7A-7I), the size of the opening at the front of the vent can be increased allowing for an increase in the NFVA. For example, in some embodiments, the NFVA can be increased by about 10%, 15%, 25%, 30%, 33%, 40%, 50%, 60%, 66%, 70%, 75%, 80%, 90%, 100%, 125%, 150%, 175%, 200%, 225%, 250%, 275%, 300%, 325%, 350%, 375%, 400%, 425%, 450%, 475%, or 500%, relative to the same vent without a diverter.

Figure 8A:
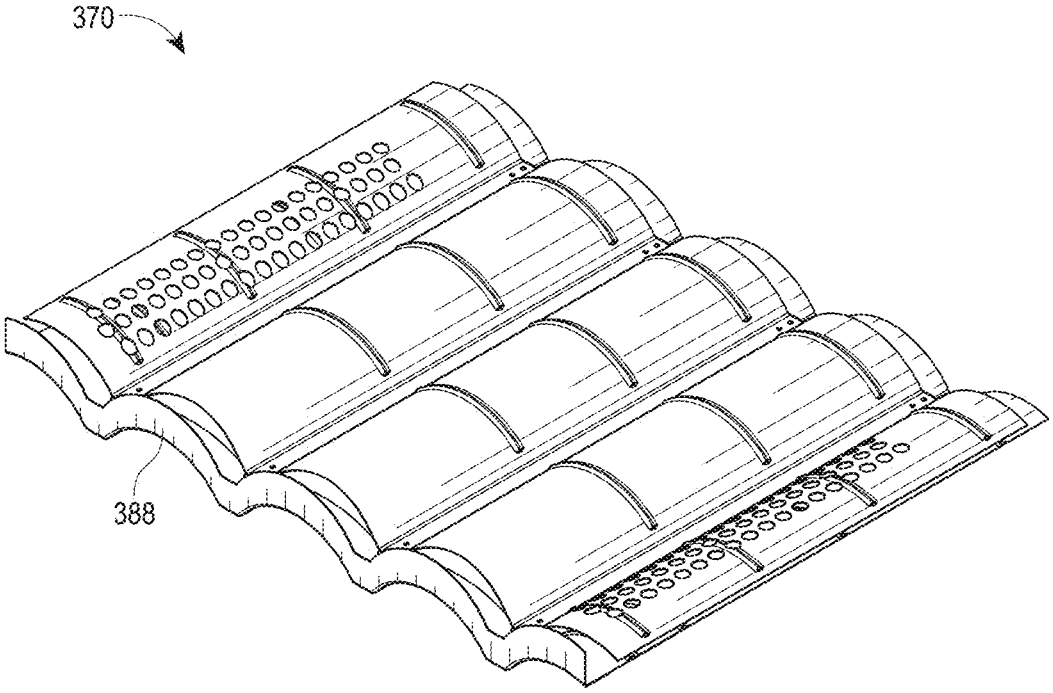
FIGS. 8A-8I illustrate various embodiments of M-shaped roof vents that include diverters.
Figure 8B:
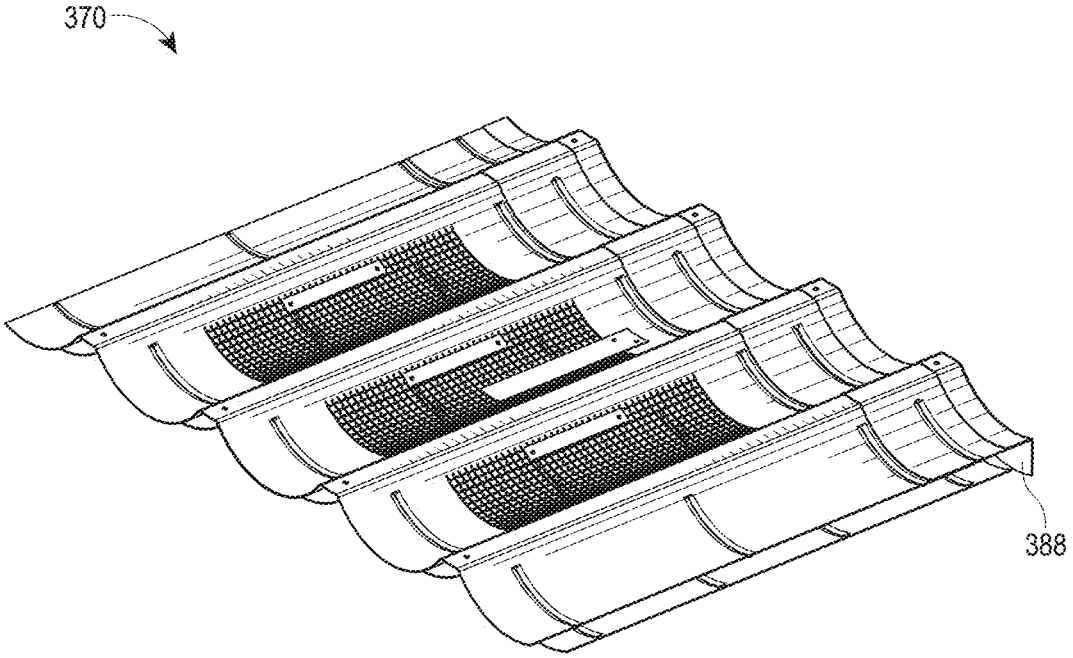
Figure 8C:
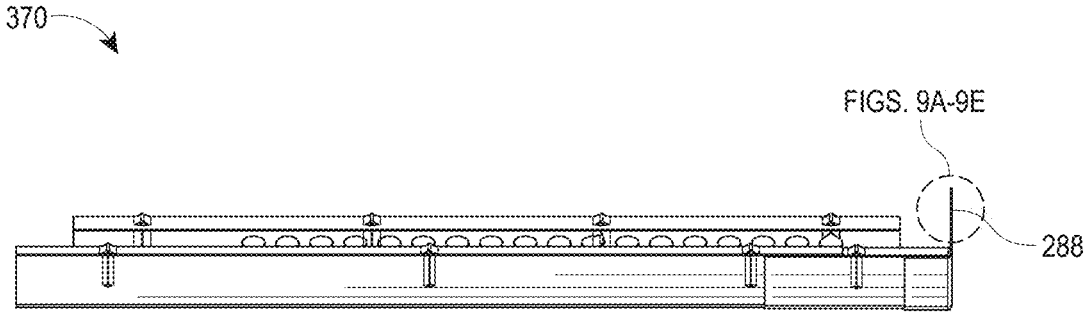

FIGS. 8A-8I illustrate various embodiments of M-shaped roof vents 370 that include diverters 388. In some embodiments, the M-shaped roof vents 370 can be configured to mimic the appearance of M-shaped roof tiles. FIGS. 8A and 8B are isometric top and bottom views of the M-shaped roof vent 370 that includes an embodiment of a diverter 388. The diverter 388 can be configured and positioned as described above to prevent or reduce the likelihood that wind or other forces can drive water or other debris through the vent 370. FIG. 8C is a side view of the M-shaped roof vent 370 illustrating an example profile for the diverter 388. The diverter 388 may comprise other profiles or shapes as illustrated, for example, in FIGS. 9A-9E discussed further below.

Figure 8D:
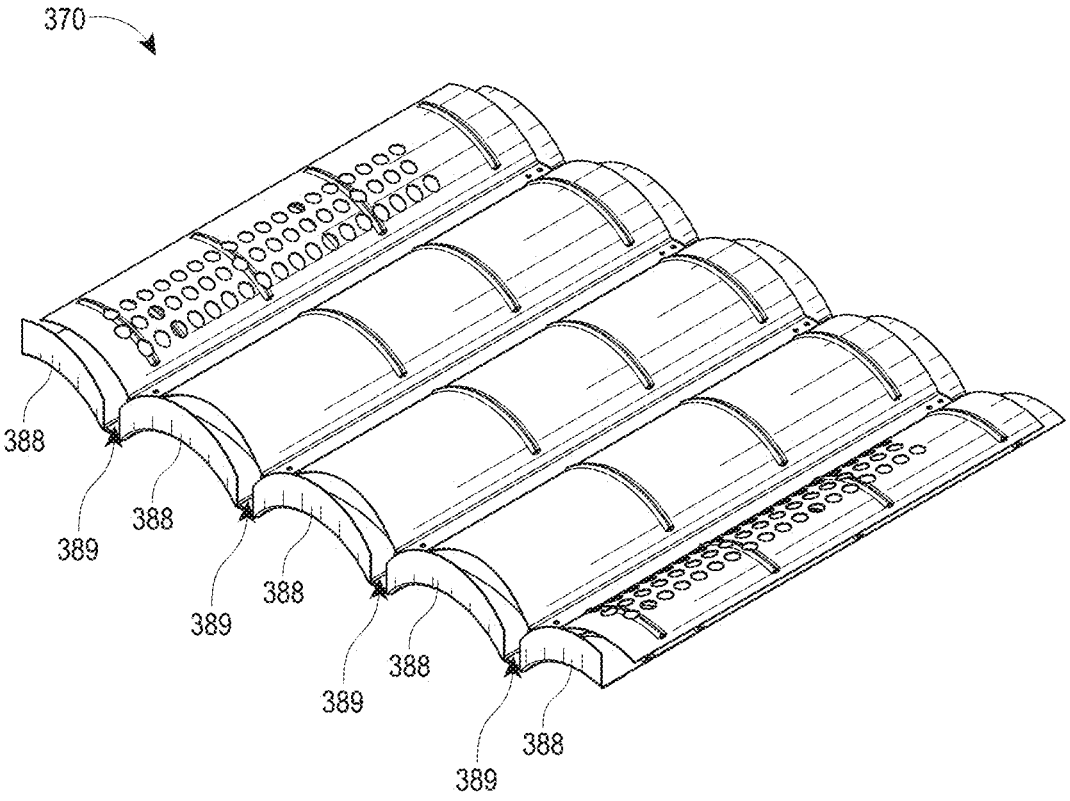

FIG. 8D is an isometric top view of an embodiment of the M-shaped roof vent 370 that includes an embodiment of a non-continuous diverter 388, e.g., with cutouts 389. As described above, the cutouts 389 may divide the diverter 388 into one or more portions. The cutouts 389 may be configured to provide tool access (e.g., to a crimping tool) used during manufacture of the vent and/or provide access for debris removal as described above. Although four cutouts 389 are illustrated, the M-shaped roof vent 370 may include other numbers of cutouts 389 in other embodiments.

Figure 8E:
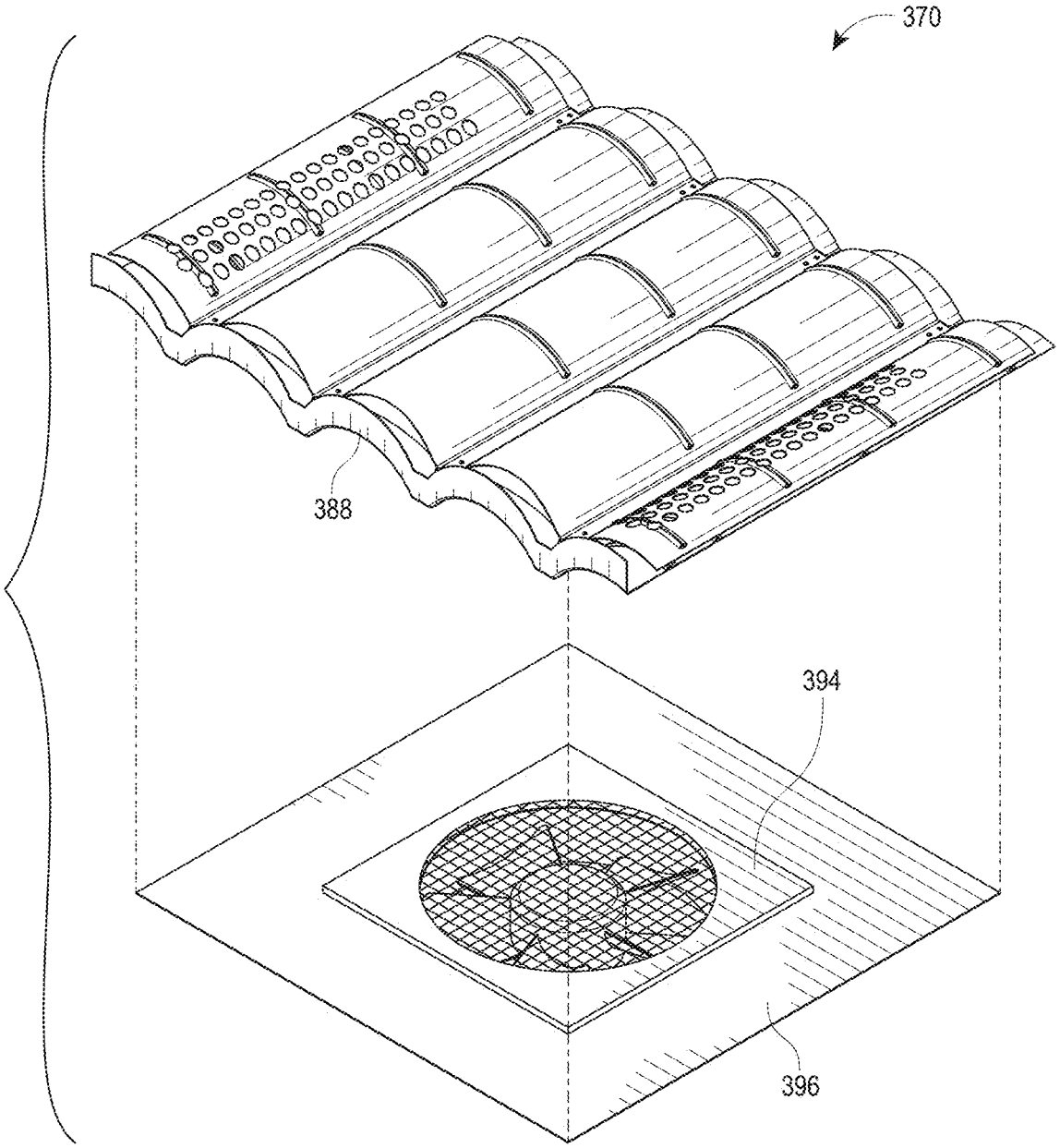
Figure 8F:
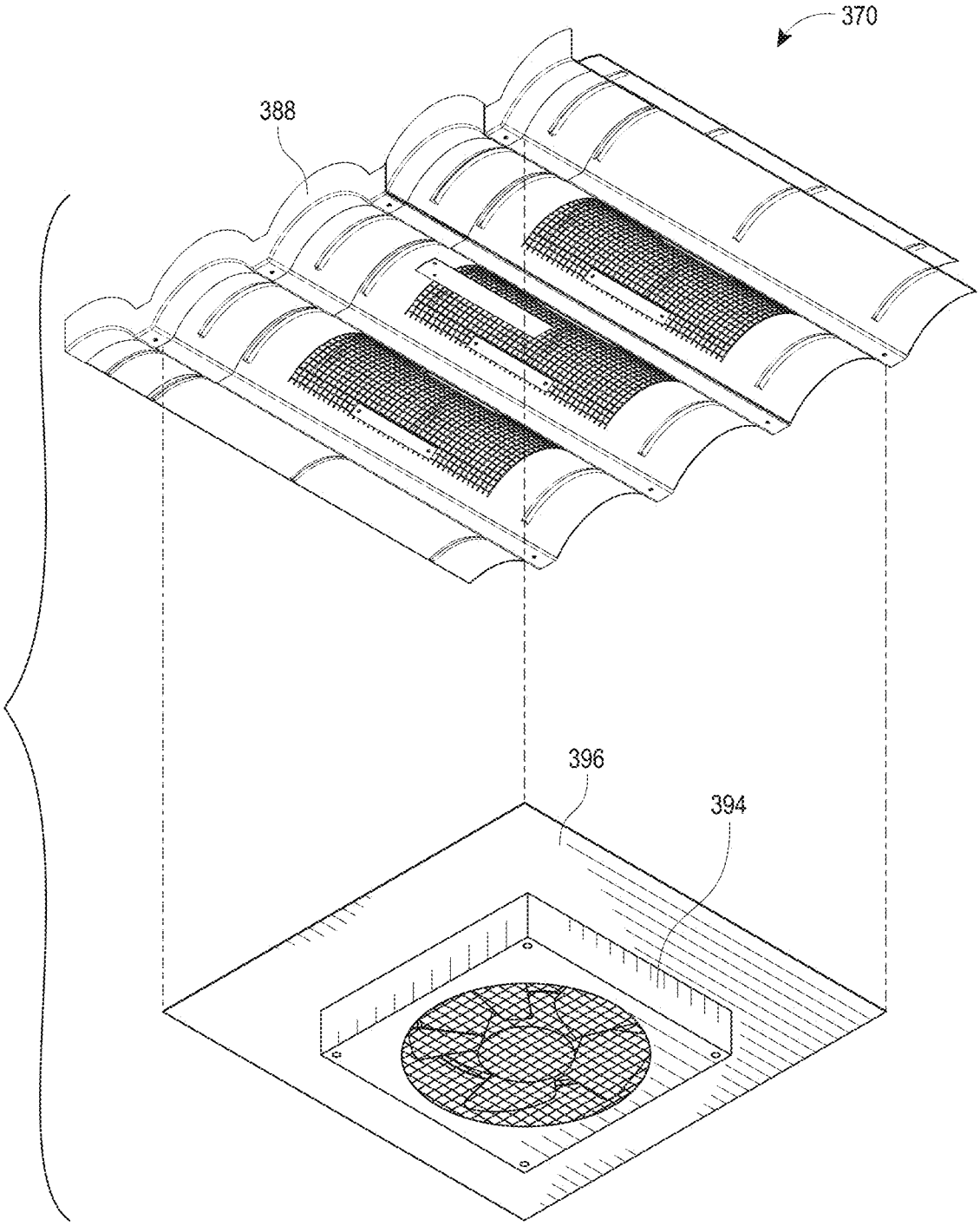

FIGS. 8E and 8F are top and bottom exploded views of an embodiment of the M-shaped roof vent 370 that includes an embodiment of a fan 396. As before, the fan 396 may be configured to provide active ventilation through the M-shaped roof vent 370. In the illustrated embodiment, the fan 394 is provided with a flange 396 on a primary vent member. The flange 396 can allow the fan 394 to be mounted to the roof deck. The secondary vent member of the vent 370 (i.e., the M-shaped portion) can then be positioned over the fan 394. In some embodiments, the vent 370 and the fan 394 comprise separate components. In some embodiments, the fan 394 can be attached to the vent 370.

Figure 8G:
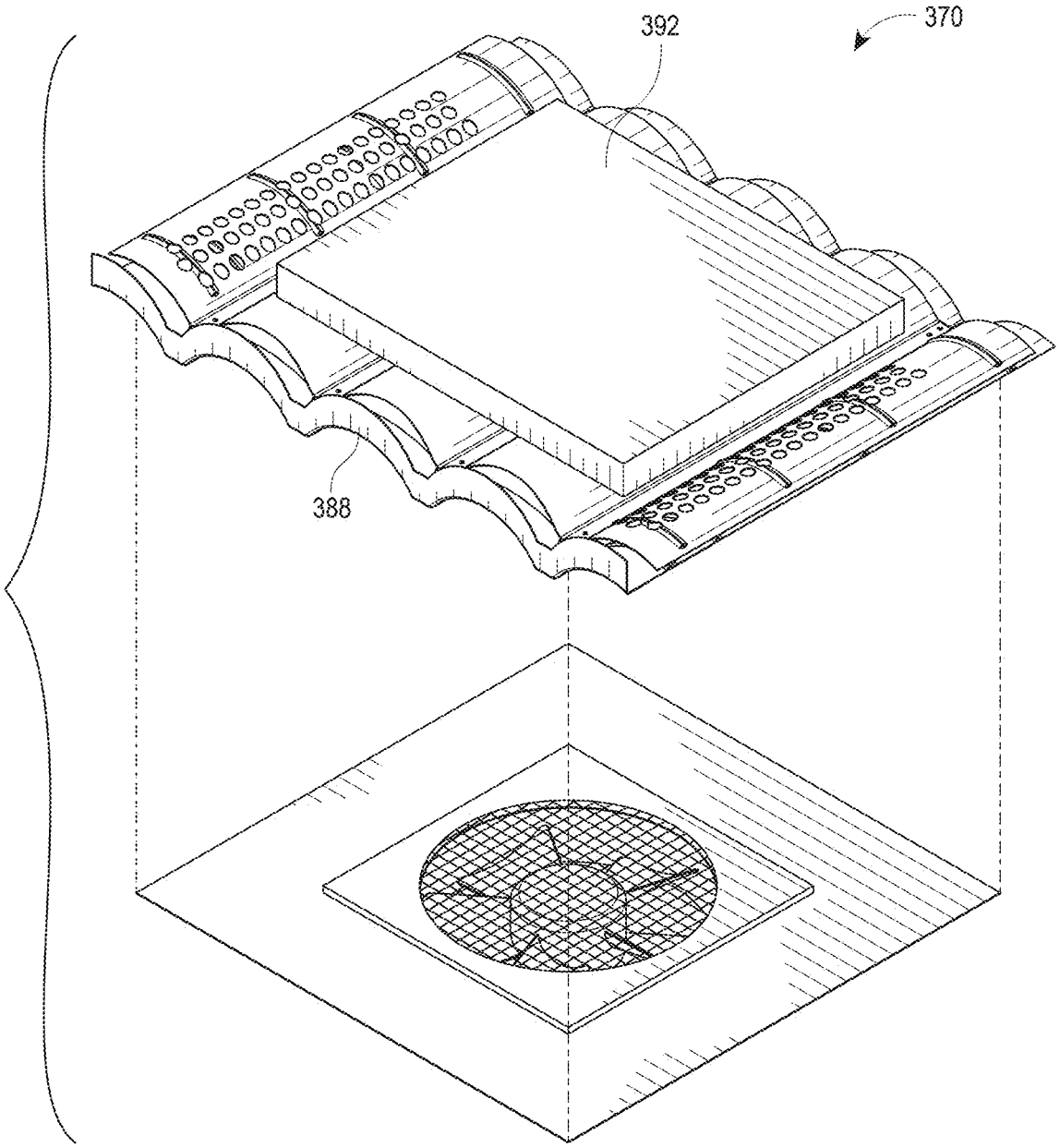
Figure 8H:
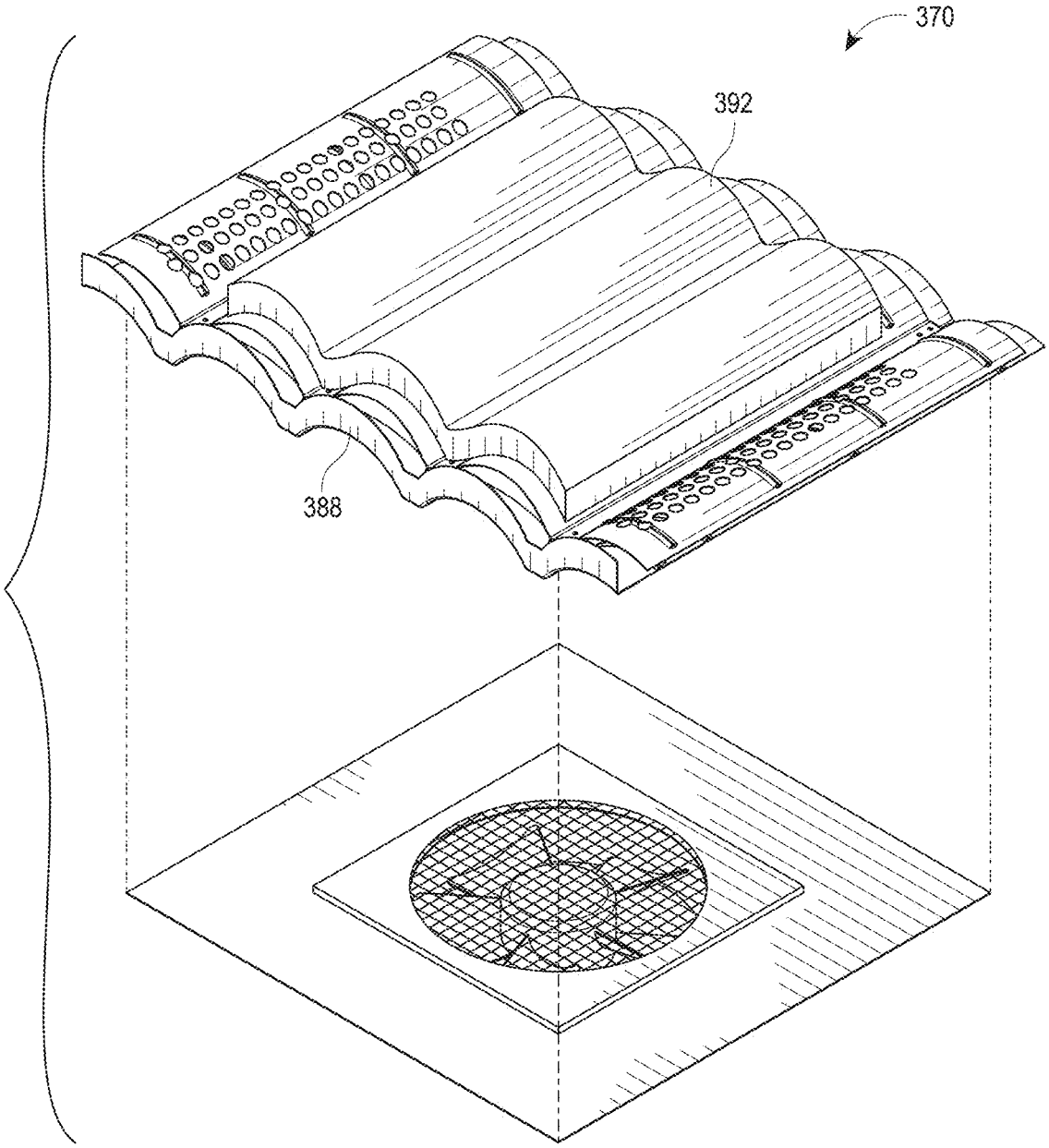
Figure 8I:
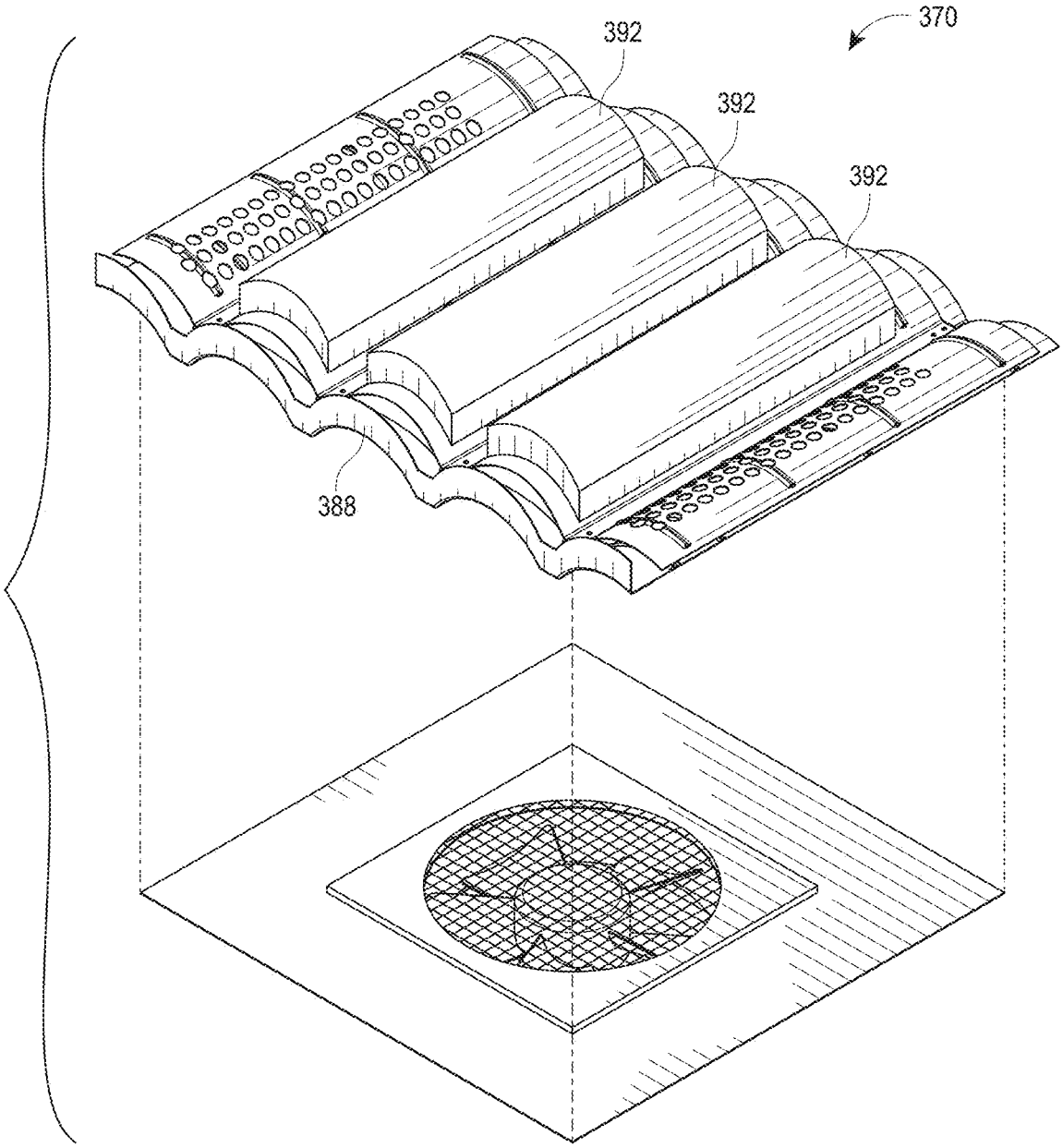

FIGS. 8G, 8H, and 8I are top exploded views of an embodiment of the M-shaped roof vent 370 with a diverter 380 that illustrate various embodiments of solar panels 392 that can be included thereon. Although FIGS. 8G-8I also illustrate the fan, it will be appreciated that the fan can be omitted in some embodiments. The solar panels 392 can be configured to power certain components of the vent 370 (e.g., the fan 394) to provide power for the structure on which the vent 370 is installed, and/or to provide electricity back to the power grid as mentioned above. FIG. 8G illustrates an embodiment of the vent 370 that includes a flat solar panel 392. FIG. 8H illustrates an embodiment of the vent 370 that includes a curved solar panel 392. FIG. 8I illustrates an embodiment of the vent 870 that includes three curved solar panels 392 positioned over the peaks of the vent 370.

In one example, an M-vent without a diverter can have a NFVA of about 86.25 square inches. By including a diverter (as shown, for example, in FIGS. 7A-7I), the size of the opening at the front of the vent can be increased allowing for an increase in the NFVA. For example, in some embodiments, the NFVA can be increased by about 10%, 15%, 25%, 30%, 33%, 40%, 50%, 60%, 66%, 70%, 75%, 80%, 90%, 100%, 125%, 150%, 175%, 200%, 225%, 250%, 275%, 300%, 325%, 350%, 375%, 400%, 425%, 450%, 475%, or 500%, relative to the same vent without a diverter.

FIGS. 9A-9E illustrate side or profiles views of various embodiments of diverters 88*a*-88*e* that can be included on the roof vents described herein. For example, any of the diverters 88*a*-88*e* can be included on any of the roof vents of FIG. 3A-3B, 5A-5C, 6A-6H, 7A-7I, or 8A-8I. Thus, these diverter profiles can be implemented in vents that have continuous or non-continuous diverters.

Figure 9C:
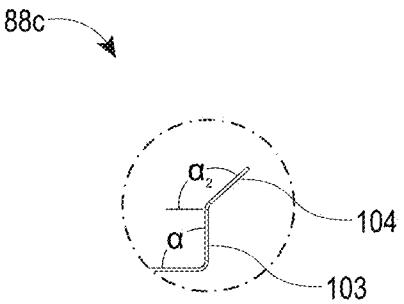
FIGS. 9A-9E illustrate side views of various embodiments of diverters that can be included on the roof vents described herein.
Figure 9B:
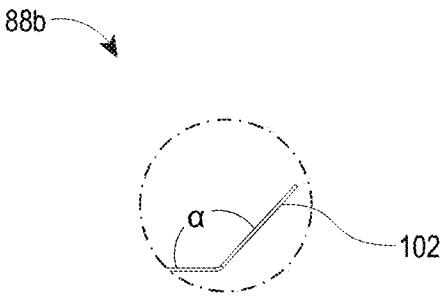
Figure 9A:
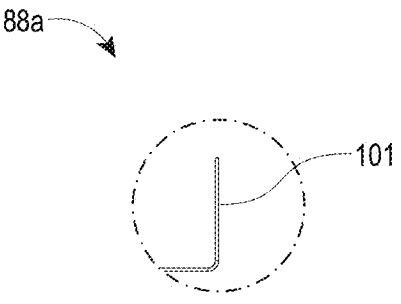

FIG. 9A illustrates an example diverter 88*a* that includes a substantially orthogonal upstand or lip 101. In some embodiments, the lip 101 extends substantially orthogonal relative to a portion of the vent, such as the lower portion or bottom mounting surface of the vent, such that the diverter is approximately orthogonal relative to the roof deck over which the vent is installed. The lip 101 can be approximately vertical, relative to the overall positioning of the vent on a surface. In the illustrated embodiment, the lip 101 is substantially straight.

FIG. 9B illustrates an example diverter 88*b* that includes an angled upstand or lip 102. In some embodiments, the lip 102 is angled in a downslope direction. In some embodiments, the lip 102 is angled in an upslope direction. The lip 102 may be angled with an angle α that can be defined as the angle between the lip 102 and the lower portion or bottom mounting surface of the vent or the angle between the lip 102 and the plane of the roof deck. In some embodiments, the angle α can be about, at least about, or no greater than 30 degrees, about 40 degrees, about 45 degrees, about 50 degrees, about 60 degrees, about 70 degrees, about 80 degrees, about 100 degrees, about 110 degrees, about 120 degrees, about 130 degrees, about 135 degrees, or about 140 degrees, with other angles α also being possible, including any reasonable angle that is greater than or less than the listed values, or range between any of these values.

FIG. 9C illustrates an example diverter 88*c* that includes an outwardly extending (e.g., orthogonal) first portion 103 that extends generally upwardly away from the lower portion or bottom mounting surface of the vent, or relative to the roof deck over which the vent is installed, at a first angle α, and an angled second portion 104 that extends generally away from a distal end of the first portion 103 at a second angle α2, relative to the lower portion or bottom mounting surface of the vent, or relative to the roof deck over which the vent is installed as shown. The first portion 103 can extend orthogonally, as shown, and similar to FIG. 9A, or at various angles, similar to FIG. 9B. In this embodiment, the diverter 88*c* first extends orthogonally upward (the orthogonal portion 103) before angling away in either an upslope or a downslope direction (the angled portion 104). The angled portion 104 can be bent relative to the orthogonal portion at an angle α as shown. The angle α may comprise any of the values previously described with respect to FIG. 9B.

Figure 9E:
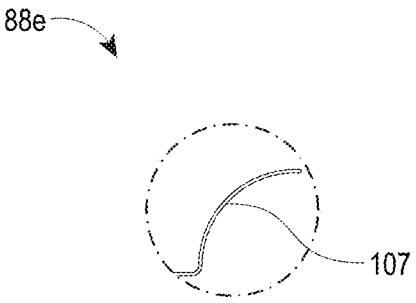
Figure 9D:
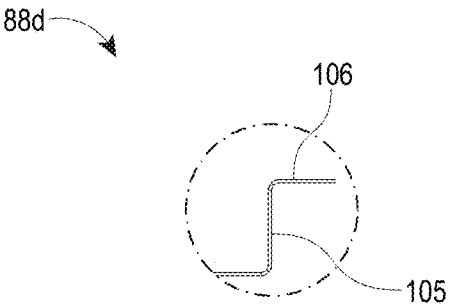

FIG. 9D illustrates an example diverter 88*d* that includes a first outwardly extending orthogonal portion 105 and a second outwardly extending portion 106. As illustrated, the first orthogonal portion 105 extends upwardly, similarly to the orthogonal lip 101 in FIG. 9A. The second orthogonal portion 106 extends orthogonally from the top of the first orthogonal portion 105. In the illustrated embodiment, the second orthogonal portion 106 extends in the downslope direction. In other embodiments, the second orthogonal portion 106 may extend in the upslope direction.

FIG. 9E illustrates an example diverter 88*e* that includes a curved portion 107. The portion 107 may curve in an upslope or downslope direction. The curved portion 107 can be convex or concave. The curved portion 107 may have a constant radius or a radius that changes over the curve of the lip. The curved portion 107 can extend from the lower portion or bottom mounting surface of the vent, as shown, or can extend from a first approximately straight outwardly extending portion that extends from the lower portion of bottom mounting surface of the vent.

Although various diverters 88*a*-88*e* have been illustrated in FIGS. 9A-9E, these examples are not intended to be limiting. Other diverter profiles are possible as will be apparent to those skilled in the art upon consideration of this disclosure and these are intended to be within the scope of this application.

Figure 10:
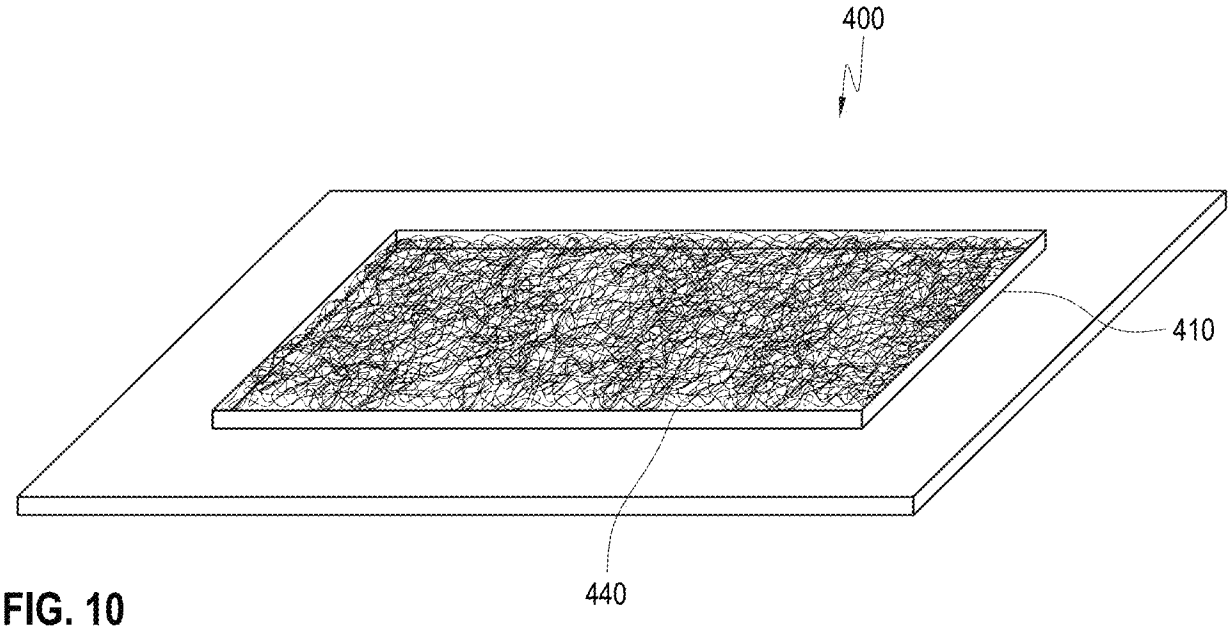
FIG. 10 illustrates an embodiment of a vent member with an ember impedance structure.

In some embodiments, vents including diverters (such as the vents of FIGS. 3A-3B, and 5A-8I) can include an ember impedance structure formed over one or more openings in the vent. The ember impedance structure can be configured to prevent embers from entering through the vent. The ember impedance structure can be configured to permit air flow through the openings, while limiting or preventing embers from passing through the opening. FIG. 10 illustrates an example vent member 400 that includes an opening 410. that includes an ember impedance structure that is configured as a mesh material 440. Although illustrated as a rectangular opening in FIG. 10, the opening 410 may be any opening in any of the vents previously described, including openings in one or both of a primary vent member or a secondary vent member. Further, the vent member 400 can be any type of vent illustrated above, including a tapered composition vent, a flat vent, an S-vent, or an M-vent, which as discussed above can include a diverter.

With continued reference to FIG. 10, the vent member 400 includes an ember impedance structure comprising a mesh material 440 within the opening 410. In certain embodiments, the mesh material 440 is a fibrous interwoven material. In certain embodiments, the mesh material 440 is flame-resistant. The mesh material 440 can be formed of various materials, one of which is stainless steel. In one preferred embodiment, the mesh material 440 is stainless steel wool made from alloy type AISI 434 stainless steel, approximately ¼ inches thick. This particular steel wool can resist temperatures in excess of 700° C. as well as peak temperatures of 800° C. (up to 10 minutes without damage or degradation), does not degrade significantly when exposed to most acids typically encountered by roof vents, and retains its properties under typical vibration levels experienced in roofs (e.g., fan-induced vibration). Also, this particular steel wool provides a NFVA of approximately 133.28 inches per square foot (i.e., 7% solid, 93% open). This is a higher NFVA per square foot than the wire mesh that is used across openings in subflashings (i.e., primary vent members) of roof vents sold by O'Hagin, Inc. Some of such commercially available subflashings employ ¼" thick galvanized steel wire mesh as a thin screen. For subflashing openings of approximately 7"×19", these commercially available vents provide approximately 118 square inches of NFVA.

The mesh material can be secured to the vent member 400 by any of a variety of different methods, including without limitation adhesion, welding, and the like.

In various embodiments, the mesh material 340 substantially inhibits the ingress of floating embers. The mesh material 440 can provide resistance to the ingress of floating embers, without overly limiting ventilation airflow. As noted above, a mesh material 440 comprising stainless steel wool made from alloy type AISI 434 stainless steel provides a NFVA of approximately 133.28 inches per square foot (i.e., 7% solid, 93% open). The increased NFVA provided by the mesh material 440 makes it possible for a system employing vent members 400 to meet building codes (which typically require a minimum amount of NFVA) using a reduced number of vents, providing a competitive advantage for builders and roofers in terms of total ventilation costs.

As noted above, the mesh material 440 can be applied to one or more openings of any of the vents described above to improve the fire resistance of the vents.

Figure 11A:
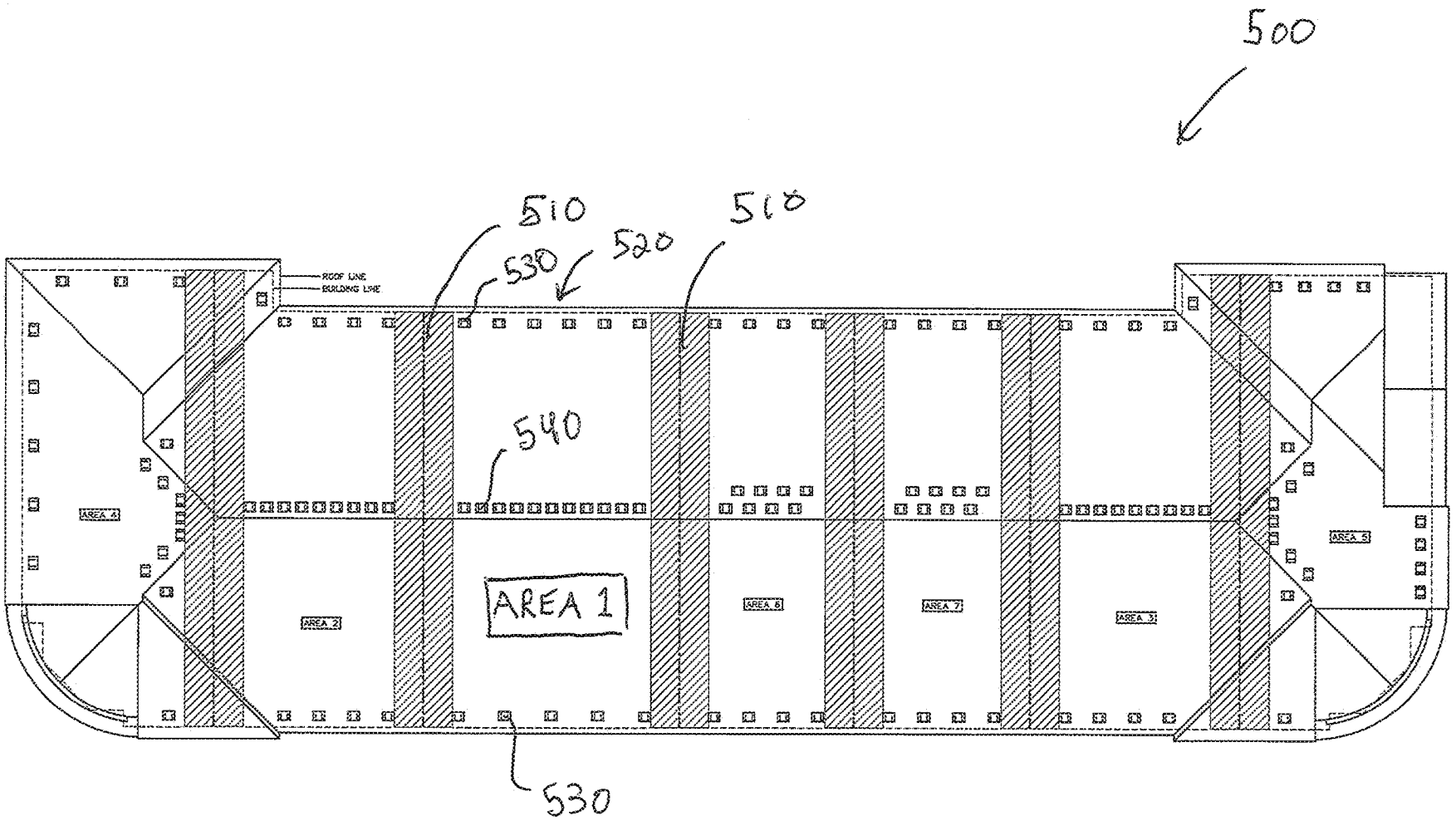
FIGS. 11A-11B illustrate top plan views of roofs with ventilation systems that implement a plurality of roof vents described herein.
Figure 11B:
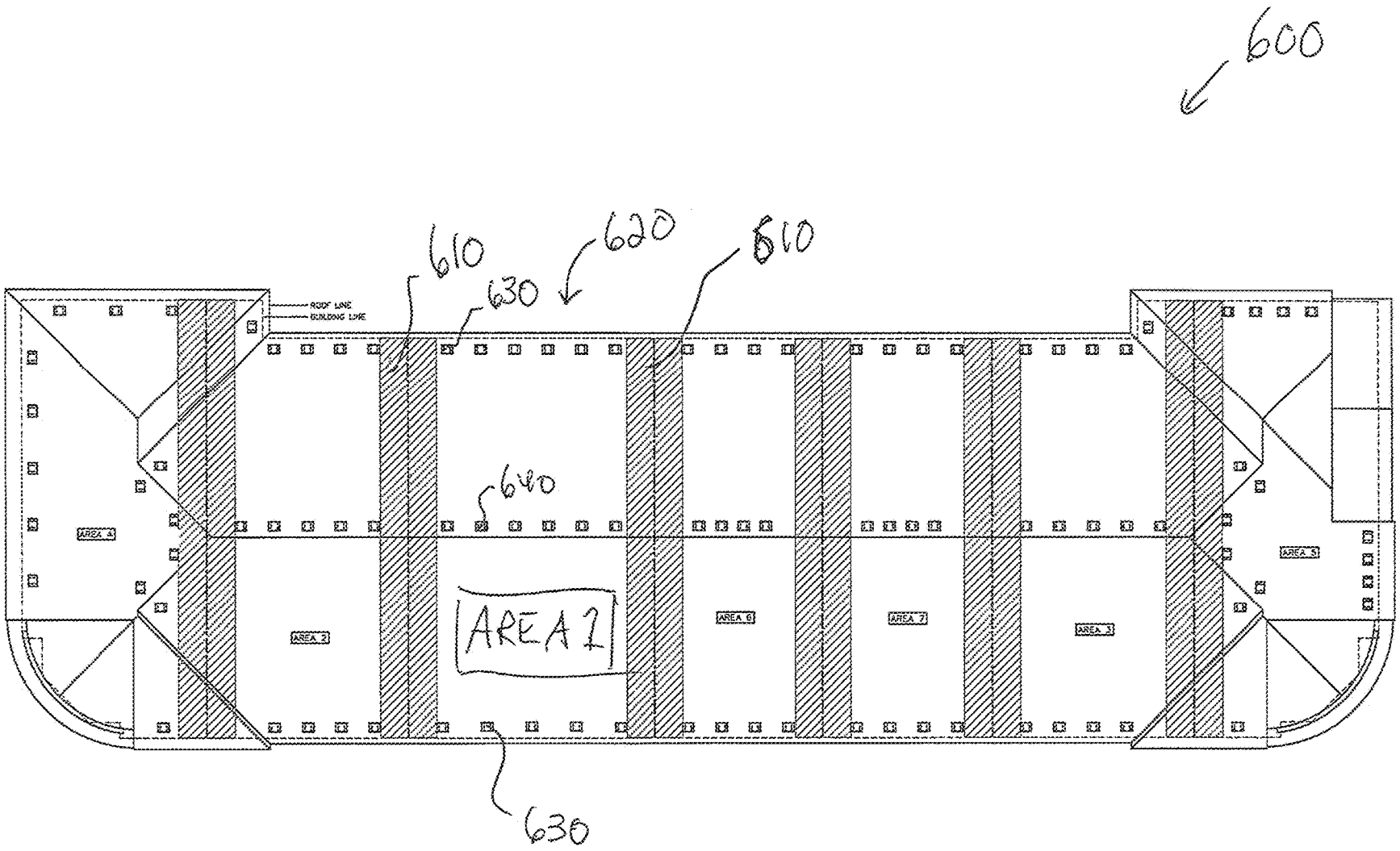

FIGS. 11A-11B illustrate top plan views of roofs with ventilation systems that implement a plurality of roof vents as described herein.

With reference to FIG. 11A, a roof 500 and the space under the roof, such as the attic, can comprise a plurality of Areas 1-7. Areas 1-7 may divide the overall square footage of the roof 500 and attic into separate sections. Some embodiments include walls 510 or other structure separating each section. For example, walls 510 may be provided to meet building fire code requirements, and form a barrier between the Areas 1-7. Such barriers can prevent a fire from "engulfing" the entire open attic space, which can happen without such barriers. The positioning, shape, and/or size of the Areas 1-7 and walls 510 may be defined by building code, based upon square footage, the elevation of various portions of the house, and/or other factors.

Roof 500 may comprise an overall roof ventilation system with a first and second plurality of vents to ventilate the overall attic space beneath the roof. The overall roof ventilation system may include a number of area roof ventilation systems, each with a first and second plurality of vents, corresponding to each of the Areas 1-7. In the illustrated embodiments, for example, Area 1 includes a roof ventilation system 520 comprising a first plurality of vents 530 and a second plurality of vents 540. The first plurality of vents 530 are generally positioned at a lower elevation on the roof, for example, near the eaves, relative to the second plurality of vents 540, which may be positioned at a higher elevation on the roof, for example, near the ridge. Areas 2-7 can each include a similar area roof ventilation system, each with first and second plurality of vents, positioned at higher and lower elevations on the roof relative to each other. The area roof ventilations systems for Areas 1-7 collectively form the overall roof ventilation system of roof 500.

In theory, during ventilation, all of a first plurality of vents allow for flow into the attic space, while all of the other plurality of vents allow for flow out of the attic space. For example, cooler air may be drawn into the attic through vents 530 at the eaves, allowing warmer air to rise and be vented from the attic through the vents 540 at the ridge, or vice versa.

Under some building codes, the amount of overall ventilation flow (e.g., total NVFA) provided by the first plurality of vents needs to be approximately the same as the amount of ventilation flow provided by the second plurality of vents. This "flow balancing" is generally required by code for the overall flow between upper and lower vents of an overall roofing ventilation system, and for any given sectioned area under the roof, such as Areas 1-7. For simple, older, rectangular houses, this would often result in a row of similar vents with similar flow capacities relative to each other, spaced along the bottom eaves of a house, with a corresponding spaced row of similar flow vents (relative to each other, and relative to those at the eaves) in the same quantity, at the ridge of a house. Modern, more complicated roofs, that are not rectangular in shape, nonetheless have similarly implemented similar vents with similar flow, for all of the upper and lower plurality of vents in any roof ventilation system. For example, Area 1 in FIG. 11A shows a total of 11 vents 530 positioned at the eaves (6 on one side, 5 on the other), with 11 corresponding vents 540 positioned at its ridge, in a row. Other Areas 2-7 show different configurations, but the upper and lower vent quantities, flow, and sizes, are all the same, relative to each other.

With continued reference to FIG. 11A, any vents that are positioned too close to each other, for example, such as the second plurality of vents 540 in Area 1 as shown in FIG. 11A, may cause reduced ventilation performance, or reduced "wind effect" due to "crowding" between the two pluralities of vents 530 and 540. This is because rather than providing ventilation flow and the wind effect from the first plurality of vents 530 to the second plurality of vents 540, some amount of "cross flow" or "ventilation interference" can occur between two adjacent vents 540. Such crowding and interference may occur, if the vents in a given plurality of vents are too close together in a row (as shown with vents 540 in Area 1, or as shown in Areas 2 and 3), or are "stacked" in separate rows, but still close together (as shown in Areas 6 and 7), or are in close "clusters" of vents (as shown in Areas 4 and 5). A decrease in ventilation performance can also occur, if the vents are stacked in separate rows (like Areas 6 and 7), but positioned on opposite sides of an eave.

In general, a roof may have more "eave space," e.g., linear space along the eaves of the roof, than "ridge space," e.g., linear space along the ridges of the roof. For example, considering the roof 500 of FIG. 11A, Area 1 comprises about twice as much eave space as ridge space (i.e., two lengths of eave space, one on each side of the building, and a single length of roof space). As noted above, it is often beneficial or required that the total NFVA of vents on the roof be divided equally between lower (e.g., eave space) and upper (e.g., ridge space) sections of the roof. Because there is often less ridge space, if all of the vents have similar NFVA values, the vents positioned near the ridges are often crowded, which can offer reduced performance as discussed above. These problems can be exacerbated further because, in some instances, at the ridges of the roof it can be beneficial to place all of the vents on a single side of the ridge, leading to further crowding.

FIG. 11B illustrates an embodiment of a roof 600, with Areas 1-7, walls 610, a roof ventilation system 620, a first plurality of vents 630, and a second plurality of vents 640, that are similar in some ways to features 500, 510, 520, 530 and 540, respectively, in FIG. 11A. A difference is that each of the individual vents 640 can be a different flow rating (e.g., a higher flow rating or higher NFVA value) relative to each of the individual vents 630. This can be achieved by implementing any of the various higher flow embodiments of the vents described herein with reference to FIGS. 1-10. Such increased individual flow for each of vents 640 can allow for overall equal flow between each of the plurality of vents 630 and 640 (to meet building code requirements), with a reduced total number of vents 640 relative to the total number of vents 630, for any Area, and the overall roof. A lower number of vents 640 that still provides equal ventilation between the lower plurality of vents (e.g. at the eaves) and the higher plurality of vents (e.g., at the ridge) can avoid ventilation "crowding" and "interference" as described above. For example, as shown, Areas 1, 2 and 3 may have a reduced quantity of higher flow vents at the ridge, allowing for increased spacing therebetween, relative to those same vents shown in FIG. 11A. The stacked vents at the ridges in FIG. 11A (Areas 6 and 7) can be eliminated, as shown in FIG. 11B, through implementation of higher flow upper vents. The "clusters" of vents shown in Areas 4 and 5 of FIG. 11A can be similarly reduced, as shown in FIG. 11B.

Thus, implementing embodiments of the higher flow vents herein within a roof ventilation system can result in the ability to have a more efficient system and method of attic ventilation.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products. For example, any of the primary and secondary vent members described herein can be provided separately, or integrated together (e.g., packaged together, or attached together) to form a single vent product.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A roof vent comprising:

a lower portion configured to be installed on a roof deck, the lower portion including an opening extending therethrough;

an upper portion attached to the lower portion at an upslope edge, the upper portion spaced apart from the lower portion at a downslope edge to create a space between the upper portion and the lower portion, the space bounded by side walls on lateral edges;

a front opening between the lower portion and the upper portion at a downslope edge of the upper portion, the front opening allowing airflow into and out of the space; and an integrated diverter positioned downslope of the front opening and attached to the lower portion, the integrated diverter (i) having a height of at least one inch and (ii) positioned downslope of the front opening at least a distance that is at least one of about 85%, 90%, 95%, 100%, 105%, 110%, or 115% of a height of the front opening;

wherein the integrated diverter comprises a non-continuous diverter including a first diverter portion spaced from a second diverter portion across a width of the diverter.

2. The roof vent of claim 1, wherein the integrated diverter extends at an angle a from the lower portion of the roof vent.

3. The roof vent of claim 2, wherein the integrated diverter comprises a first portion extending at the angle a from the lower portion of the roof vent, and a second portion extending from the first portion at an angle $\alpha$2.

4. The roof vent of claim 2, wherein the angle a is approximately 90 degrees.

5. The roof vent of claim 1, wherein the integrated diverter comprises a curved portion extending from the lower portion of the roof vent.

6. The roof vent of claim 1, wherein the integrated diverter extends continuously across the front opening of the roof vent.

7. The roof vent of claim 1, comprising one or more cutouts spaced between the first and the second diverter portions, wherein the one or more cutouts are configured to allow access to a crimping tool used during manufacture of the roof vent.

8. The roof vent of claim 1, wherein the roof vent is configured to mimic an appearance of a flat tile, an S-shaped tile, or an M-shaped tile.

9. The roof vent of claim 1, wherein the upper portion angles away from the upslope edge to create the space between the upper portion and the lower portion such that the roof vent comprises a tapered vent.

10. The roof vent of claim 1, further comprising at least one of a solar panel or a fan.

11. A roof vent system comprising:

a roof vent comprising:

a lower portion configured to be installed on a roof deck, the lower portion including an opening extending therethrough;

an upper portion attached to the lower portion at an upslope edge, the upper portion spaced apart from the lower portion at a downslope edge to create a space between the upper portion and the lower portion, the space bounded by side walls on lateral edges; and a front opening between the lower portion and the upper portion at a downslope edge of the upper portion, the front opening allowing airflow into and out of the space; and a diverter configured to be positioned downslope of the front opening of the roof vent when installed, the diverter (i) having a height of at least one inch and no more than 1.75 inches and (ii) positioned downslope of the front opening a distance that is at least one of about 85%, 90%, 95%, 100%, 105%, 110%, or 115% of a height of the front opening;

wherein the diverter comprises a non-continuous diverter including a first diverter portion spaced from a second diverter portion across a width of the diverter.

12. The roof vent system of claim 11, wherein the distance is at least equal to the height of the diverter.

13. The roof vent system of claim 11, wherein the diverter extends continuously across the front opening of the roof vent.

14. The roof vent system of claim 11, comprising one or more cutouts spaced between the first and the second diverter portions, wherein the one or more cutouts are configured to allow access to a crimping tool used during manufacture of the roof vent.

15. The roof vent system of claim 11, wherein the roof vent is configured to mimic an appearance of a flat tile, an S-shaped tile, or an M-shaped tile.

16. The roof vent system of claim 11, wherein the upper portion angles away from the upslope edge to create the space between the upper portion and the lower portion such that the roof vent comprises a tapered vent.

* * * * *